US005884253A

United States Patent [19]

Kleijn

[11] Patent Number: 5,884,253

[45] Date of Patent: Mar. 16, 1999

[54] PROTOTYPE WAVEFORM SPEECH CODING WITH INTERPOLATION OF PITCH, PITCH-PERIOD WAVEFORMS, AND SYNTHESIS FILTER

[75] Inventor: Willem Bastiaan Kleijn, Basking Ridge, N.J.

[73] Assignee: Lucent Technologies, Inc., Murray Hill, N.J.

[21] Appl. No.: 943,329

[22] Filed: Oct. 3, 1997

Related U.S. Application Data

[63] Continuation of Ser. No. 667,295, Jun. 20, 1996, abandoned, which is a continuation of Ser. No. 550,417, Oct. 30, 1995, abandoned, which is a continuation of Ser. No. 179,831, Jan. 5, 1994, abandoned, which is a continuation of Ser. No. 866,761, Apr. 9, 1992, abandoned.

[51] Int. Cl.[6] ..... G10L 5/02

[52] U.S. Cl. ..... 704/223; 704/265

[58] Field of Search ..... 395/2.1, 2.14–2.17, 395/2.28, 2.27, 2.3–2.32, 2.67, 2.71, 2.74, 2.77, 2.78; 704/210, 220

[56] References Cited

U.S. PATENT DOCUMENTS

| | | | |
|---|---|---|---|
| 3,624,302 | 11/1971 | Atal | 395/2 |
| 4,310,721 | 1/1982 | Manley et al. | 395/2 |
| 4,392,018 | 7/1983 | Fette | 395/2.74 |
| 4,435,832 | 3/1984 | Asada et al. | 395/2.74 |
| 4,601,052 | 7/1986 | Saito et al. | 395/2.74 |
| 4,850,022 | 7/1989 | Honda et al. | 704/207 |
| 4,910,781 | 3/1990 | Ketchum et al. | 704/223 |
| 4,989,250 | 1/1991 | Fujimoto et al. | 381/38 |
| 5,003,604 | 3/1991 | Okazaki et al. | 381/38 |
| 5,048,088 | 9/1991 | Taguchi | 381/38 |
| 5,119,424 | 6/1992 | Asakawa et al. | 704/208 |

OTHER PUBLICATIONS

W. Bastiaan Kleijn and Wolfgang Granzow, "Methods for Waveform Interpolation in Speech Coding," Digital Signal Processing, vol. 1, 215–230, Academic Press (1991).

W. B. Kleijn et al. "Improved Speech Quality and Efficient Vector Quantization in SELP", Proc. Int. Conf. ASSP, pp. 155–158 (1988).

S. Ono et al. "2.4 kbps pitch prediction multi–pulse speech coding", Proc. Int. Conf. ASSP, pp. 175–178 (1988).

(List continued on next page.)

*Primary Examiner*—David R. Hudspeth
*Assistant Examiner*—Donald L. Storm
*Attorney, Agent, or Firm*—Thomas A. Restaino; Kenneth M. Brown

[57] ABSTRACT

A speech coding system providing reconstructed voiced speech with a smoothly evolving pitch-cycle waveform. A speech signal is represented by isolating and coding prototype waveforms. Each prototype waveform is an exemplary pitch-cycle of voiced speech. A coded prototype waveform is transmitted at regular intervals to a receiver which synthesizes (or reconstructs) an estimate of the original speech segment based on the prototypes. The estimate of the original speech signal is provided by a prototype interpolation process which provides a smooth time-evolution of pitch-cycle waveforms in the reconstructed speech. Illustratively, a frame of original speech is coded by first filtering the frame with a linear predictive filter. Next a pitch-cycle of the filtered original is identified and extracted as a prototype waveform. The prototype waveform is then represented as a set of Fourier series (frequency domain) coefficients. The pitch-period and Fourier coefficients of the prototype, as well as the parameters of the linear predictive filter, are used to represent a frame of original speech. These parameters are coded by vector and scalar quantization and communicated over a channel to a receiver which uses information representing two consecutive frames to reconstruct the earlier of the two frames based on a continuous prototype waveform interpolation process. Waveform interpolation may be combined with conventional CELP techniques for coding unvoiced portions of the original speech signal.

10 Claims, 13 Drawing Sheets

OTHER PUBLICATIONS

B. S. Atal et al. "Beyond multipulse and CELP: Towards high quality speech at 4 kb/s", In Advances in Speech Coding, pp. 191–201 (1991).

S. Roucos et al. "High quality time–scale modification for speech", Proc. Int. Conf. ASSP, pp. 493–496 (1985).

F. Charpentier et al. "A diphone synthesis system using an overlap–add technique for speech waveforms concatenation", Proc. Int. Conf. ASSP, pp. 207–210 (1989).

PROTOTYPE WAVEFORM SPEECH CODING WITH INTERPOLATION OF PITCH, PITCH-PERIOD WAVEFORMS, AND SYNTHESIS FILTER

This application is a continuation of application Ser. No. 08/667,295, filed Jun. 20, 1996, now abandoned, which is a continuation of application Ser. No. 08/550,417, filed Oct. 30, 1995, now abandoned, which is a continuation of application Ser. No. 08/179,831, filed Jan. 5, 1994, now abandoned, which is a continuation of application Ser. No. 07/866,761, filed Apr. 9, 1992, now abandoned.

FIELD OF THE INVENTION

The present invention relates generally to the field of speech coding, and more particularly to speech coding at low bit-rates.

BACKGROUND OF THE INVENTION

Communication of speech information often involves transmitting electrical signals which represent speech over a channel or network ("channel"). A problem commonly encountered in speech communication is how to transmit speech through a channel of limited capacity or bandwidth (in modern digital communications systems, bandwidth is often expressed in terms of bit-rate). The problem of limited channel bandwidth is usually addressed by the application of a speech coding system, which compresses a speech signal to meet channel bandwidth requirements. Speech coding systems include an encoder, which converts speech signals into code words for transmission over a channel, and a decoder, which reconstructs speech from received code words.

As a general matter, a goal of most speech coding systems concomitant with that of signal compression is the faithful reproduction of original speech sounds, such as, e.g., voiced speech. Voiced speech is produced when a speaker's vocal cords are tensed and vibrating quasi-periodically. In the time domain, a voiced speech signal appears as a succession of similar but slowly evolving waveforms referred to as pitch-cycles. Each pitch-cycle has a duration referred to as a pitch-period. Like the pitch-cycle waveform itself, the pitch-period generally varies slowly from one pitch-cycle to the next.

Many speech coding systems which operate at bit-rates around 8 kilobits per second (kb/s) code original speech waveforms by exploiting knowledge of the speech generation process. Illustrative of these so-called waveform coders are the code-excited linear prediction (CELP) speech coding systems.

A CELP system codes a speech waveform by filtering it with a time-varying linear prediction (LP) filter to produce a residual speech signal. During voiced speech, the residual signal comprises a series of pitch-cycles, each of which includes a major transient referred to as a pitch-pulse and a series of lower amplitude vibrations surrounding it. The residual signal is represented by the CELP system as a concatenation of scaled fixed-length vectors from a codebook. To achieve a high coding efficiency of voiced speech, most implementations of CELP also include a long-term predictor (or adaptive codebook) to facilitate reconstruction of a communicated signal with appropriate periodicity. Despite improvements over time, many waveform coding systems operating at rates below 6 kb/s suffer from perceptually significant distortion, typically characterized as noise.

Coding systems which operate at rates of 2.4 kb/s are generally parametric in nature. That is, they operate by transmitting parameters describing pitch-period and the spectral envelope (or formants) of the speech signal at regular intervals. Illustrative of these so-called parametric coders is the LP vocoder system.

LP vocoders model a voiced speech signal with a single pulse per pitch period. This basic technique may be augmented to include transmission information about the spectral envelope, among other things. Although LP vocoders provide reasonable performance generally, they may introduce perceptually significant distortion, typically characterized as buzziness.

The types of distortion discussed above, and another—reverberation—common in sinusoidal coding systems, are generally the result of reconstructed speech which lacks (in whole or in significant part) the pitch-cycle dynamics found in original voiced speech. Naturally, these types of distortion are more pronounced at lower bit-rates, as the ability of speech coding systems to code information about speech dynamics decreases.

SUMMARY OF THE INVENTION

A speech coding system providing reconstructed voiced speech with a smoothly evolving pitch-cycle waveform is provided by the present invention. The invention represents a speech signal by isolating and coding prototype waveforms. Each prototype waveform is an exemplary pitch-cycle of voiced speech. A coded prototype waveform is transmitted at, e.g., regular intervals to a receiver which synthesizes (or reconstructs) an estimate of the original speech segment based on the prototypes. The estimate of the original speech signal is provided by a prototype interpolation process. This process provides a smooth time-evolution of pitch-cycle waveforms in the reconstructed speech.

An illustrative embodiment of the present invention codes a frame of original speech by first filtering the frame with a linear predictive filter. Next, a pitch-cycle of the filtered original is identified and extracted as a prototype waveform. The prototype waveform is then represented as a set of Fourier series coefficients. The pitch-period and Fourier coefficients of the prototype, as well as the parameters of the linear predictive filter, are used to represent a frame of original speech. These parameters are coded by vector and scalar quantization and communicated over a channel to a receiver. The receiver uses information representing two consecutive frames to reconstruct the earlier of the two frames. Reconstruction is based on a continuous prototype waveform interpolation process.

Waveform interpolation may be combined with conventional CELP techniques for coding unvoiced portions of the original speech signal.

BRIEF DESCRIPTION OF THE DRAWINGS

FIG. 16(*b*) presents a prototype, aligned with a reconstructed residual of the frame of FIG. 16(*a*), which serves as a basis for prototype interpolation in a subsequent frame.

DETAILED DESCRIPTION

A. Introduction

For clarity of explanation, the illustrative embodiment of the present invention includes individual functional blocks (including functional blocks labeled as "processors"). The functions these blocks represent may be provided through the use of either shared or dedicated hardware, including, but not limited to, hardware capable of executing software. (Use of the term "processor" should not be construed to refer exclusively to hardware capable of executing software.) Illustrative embodiments may comprise digital signal processor (DSP) hardware, such as the AT&T DSP16 or DSP32C, and software performing operations discussed below. Very large scale integration (VLSI) hardware embodiments of the present invention, as well as hybrid DSP/VLSI embodiments, may also be provided. Various buffers and "stores" described in the embodiments may be realized with conventional semiconductor random access memory (RAM).

B. The Encoder

Figure 1:
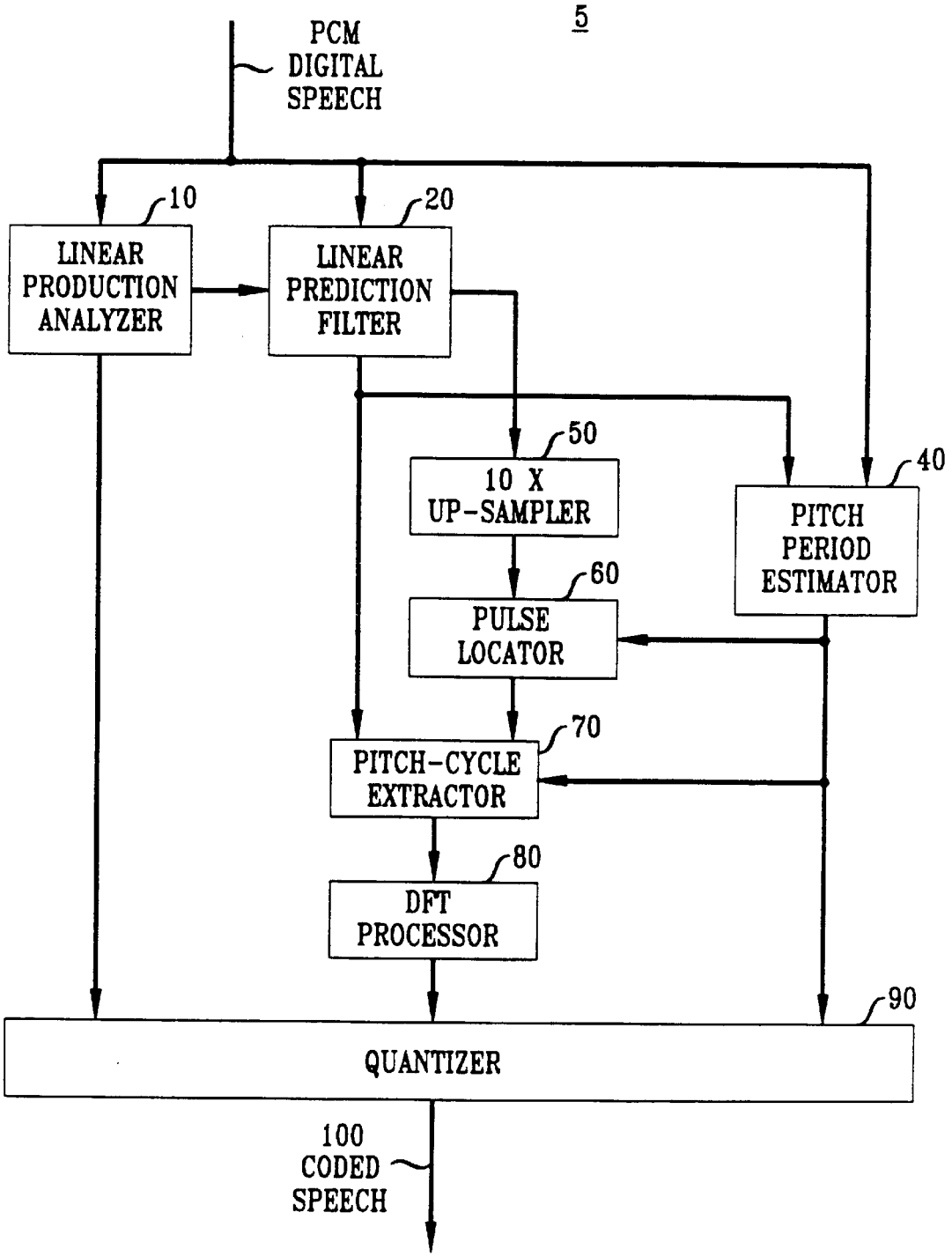
FIG. 1 presents an illustrative embodiment of an encoder according to the present invention.

An illustrative embodiment of an encoder 5 according to the present invention is presented in FIG. 1. As shown in the Figure, encoder 5 receives pulse-code modulated (PCM) digital speech signals, x, as input, and produces as output coded speech to a communications channel 100.

PCM digital speech is provided by a combination of, e.g., a microphone converting acoustic speech signals to analog electrical signals, an analog low-pass filter with cutoff frequency at 3,600 Hz, and an analog-to-digital converter operating at 8,000 samples per second (combination not shown). Communications channel 100 may comprise, e.g., a telecommunications network such as a telephone network or radio link, or a storage medium such as a semiconductor memory, magnetic disk or tape memory or CD-ROM (combinations of a network and a storage medium may also be provided). Within the context of the present invention, a receiver (or decoder) receives signals communicated via the communications channel. So, e.g., a receiver may comprise a CD-ROM reader, a disk or tape drive, a cellular or conventional telephone, a radio receiver, etc. Thus, the communication of signals via the channel may comprise, e.g., signal transmission over a network or link, or signal storage in a storage medium, or both. Encoder 5 comprises a linear prediction analyzer 10, a linear prediction filter 20, a pitch-period estimator 40, an up-sampler 50, a pulse locator 60, a pitch-cycle extractor 70, a discrete Fourier transform processor 80, and a quantizer 90.

As a general matter, encoder 5 operates to encode individual sets of input speech signal samples. These sets of samples are referred to as frames. Each frame comprises, e.g., 160 speech samples (i.e., 20 ms of speech at 8 kHz sampling rate). In coding an individual frame of speech, encoder 5 performs certain operations on subsets of a frame referred to as sub-frames (or blocks). Each sub-frame comprises, e.g., 40 speech samples (i.e., 5 ms of speech).

Figure 2:
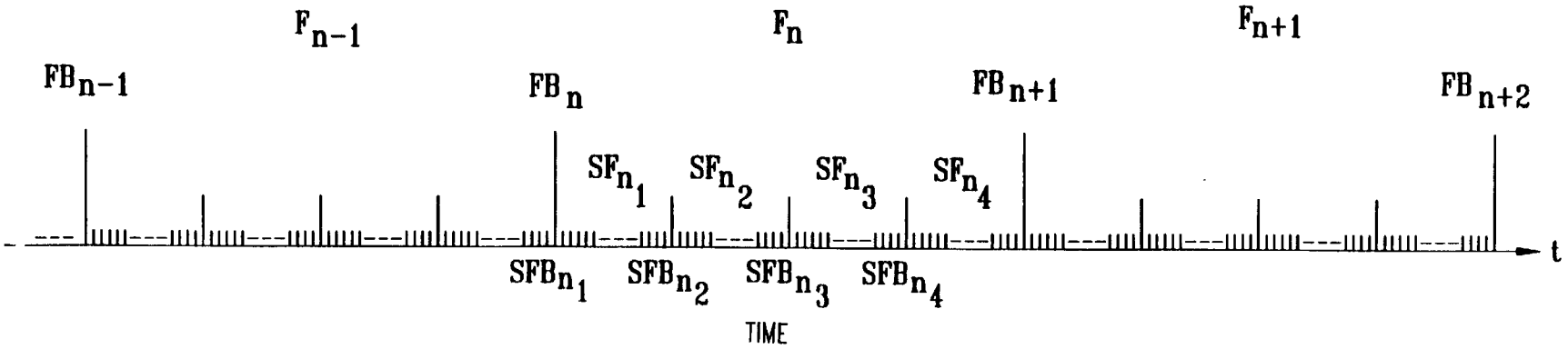
FIG. 2 presents a time-line of discrete speech signal sample points.

FIG. 2 presents a time-line of discrete speech signal sample points (for the sake of clarity, actual sample values are not shown). These sample points are grouped into frames. The current frame of speech signals to be coded is designated as frame $F_n$ by convention. The boundary between the current frame and previous frame of speech samples is designated $FB_n$ (i.e., a boundary is associated with the frame to its right); similarly, the boundary between the current and next frames is designated as $FB_{n+1}$. Sub-frames within frame $F_n$ are designated as $SF_{n_1}$, $SF_{n_2}$, $SF_{n_3}$ and $SF_{n_4}$. The boundaries between the sub-frames of frame $F_n$ are designated $SFB_{n_1}$, $SFB_{n_2}$, $SFB_{n_3}$ and $SFB_{n_4}$ (where $SFB_{n_1}=FB_n$).

1. The Linear Prediction Analyzer

Figure 3:
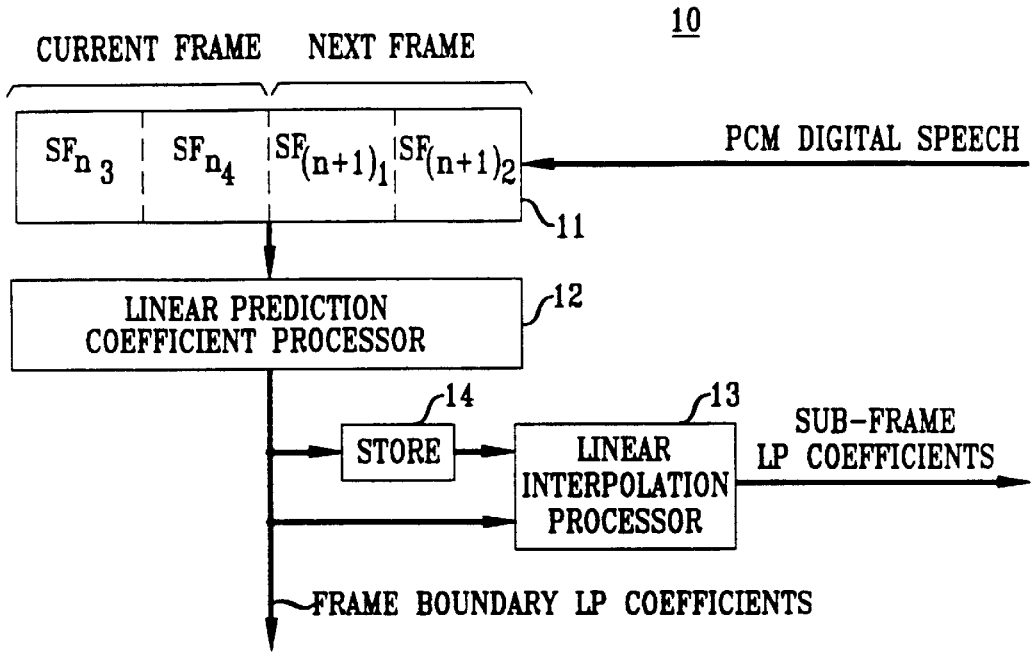
FIG. 3 presents the linear prediction analyzer of FIG. 1.

FIG. 3 presents the linear prediction analyzer 10 of FIG. 1. Analyzer 10 comprises a buffer 11 of length 160 samples, a conventional linear prediction coefficient processor 12, a delay storage memory 14 and a conventional linear interpolation processor 13. Analyzer 10 receives PCM digital speech samples, x, and determines linear prediction coefficients valid at frame boundaries and the center of intervening sub-frames in a conventional manner well known in the art.

Figure 4:
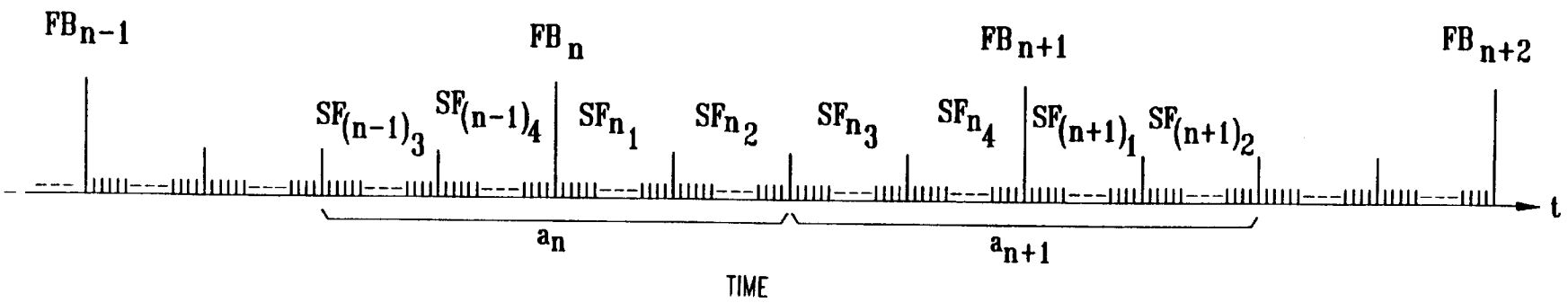
FIG. 4 presents a time-line of discrete speech signal sample points used to compute linear prediction coefficients.

The linear prediction coefficient processor 12 of analyzer 10 determines vectors of linear prediction coefficients which are valid at frame boundaries. As shown in FIG. 4, a vector of coefficients valid at frame boundary $FB_n$, $a_n$, are determined based on speech samples contained in (i) the two sub-frames immediately preceding $FB_n$ (i.e., $SF_{(n-1)_3}$ and $SF_{(n-1)_4}$, stored in the first half of buffer 11) and (ii) the two sub-frames immediately following $FB_n$ (i.e., $SF_{n_1}$ and $SF_{n_2}$, stored in the second half of buffer 11). After processor 12 determines coefficients $a_n$, the contents of buffer 11 are overwritten by the next four consecutive sub-frames of the digital speech signal. The vector of linear prediction coefficients valid at frame boundary $FB_{n+1}$, $a_{n+1}$, are next determined based on a similar set of sub-frames also shown in FIG. 4. FIG. 3 illustratively shows the buffer 11 contents required to determine $a_{n+1}$. Advantageously, the coefficients can be quantized just after computation so as to provide symmetry with computations performed by the decoder.

After the computation of linear prediction coefficients valid at frame boundaries, the linear interpolation processor 13 of analyzer 10 determines linear prediction coefficients valid at the center of intervening sub-frame boundaries. For this purpose, store 14 buffers coefficients at $FB_n$ (i.e., $a_n$). The determination of linear prediction coefficients at the center of sub-frames is done by interpolation of consecutive frame boundary linear prediction coefficients as described below.

Because direct interpolation of frame boundary coefficient data may lead to an unstable linear prediction filter 20, it is preferred that processor 13 transform boundary coefficient data into another domain prior to interpolation. Once interpolation of transformed coefficient data is performed by processor 13, the interpolated data is transformed back again by the processor 13. Any of the conventional transformation/interpolation procedures and domains may be used (e.g., log area ratio, arcsine of the reflection coefficients or line-spectral frequency domains). See, e.g., B. S. Atal, R. V. Cox, and P. Kroon, *Spectral Quantization and Interpolation for CELP Coders,* Proc. ICASSP 69–72 (1989).

As shown in FIGS. 1 and 3, analyzer 10 provides linear prediction coefficients valid at the center of sub-frames to the linear prediction filter 20, and coefficients valid at frame boundaries to quantizer 90 for transmission over a communication channel.

2. The Linear Prediction Filter

Figure 5:
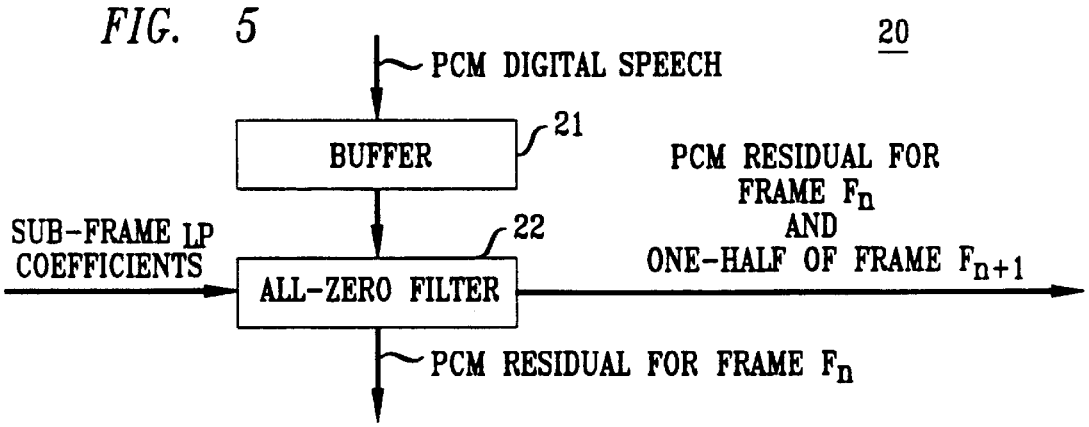
FIG. 5 presents the linear prediction filter of FIG. 1.

FIG. 5 presents the linear prediction filter 20 of FIG. 1. Linear prediction filter 20 receives PCM digital speech and filters it (using coefficients from analyzer 10) to produce a residual speech signal.

Linear prediction filter 20 comprises buffer 21. Illustratively, buffer 21 stores samples of speech corresponding to frame $F_n$, as well as samples of speech corresponding to the first two sub-frames of frame $F_{n+1}$. Linear prediction filter 20 determines a residual signal, r, by filtering each sub-frame of buffer 21 individually with filter 22 in the manner well known in the art. Each of the sub-frames corresponding to frame $F_n$ is filtered using the linear prediction coefficients valid at the center of that sub-frame. The two sub-frames from frame $F_{n+1}$ are filtered with linear prediction coefficients valid at the center of $SF_{n_4}$. However, the initial filter state retained for the start of filtering the next frame, $F_{n+1}$, is that obtained after filtering only frame $F_n$, not including the two sub-frames of $F_{n+1}$.

The transfer function of filter 22 is:

$$1 - \sum_{i=1}^{P} a_{c_i} z^{-i}, \tag{1}$$

where $a_{c_i}$ are the linear prediction coefficients for the center of a sub-frame and P is total number of coefficients, e.g., 10.

After the contents of buffer 21 are filtered as described above, all samples corresponding to frame $F_n$ are shifted out of the buffer, and samples corresponding frame $F_{n+1}$ and one-half of frame $F_{n+2}$ are shifted in and the process repeats.

All zero filter 22 provides a residual, r, comprising a present frame of filtered sub-frames, $F_n$, as output to the pitch-period estimator 40. Filter 22 also provides a residual comprising both the present frame and one-half of a next frame, $F_{n+1}$, to up-sampler 50.

3. The Pitch-Period Estimator

Pitch-period estimator 40 determines an estimate of the period of a single pitch-cycle based on the low-passed residual signal frame. Estimator 40 may be implemented according to the teachings of U.S. Pat. No. 4,879,748, entitled Parallel Processing Pitch Detector, commonly assigned herewith and incorporated by reference as if set forth in full herein. Pitch-period $p_{n+1}$ valid at $FB_{n+1}$ is provided as output to the pitch-cycle extractor 70, pulse locator 60, and quantizer 90.

4. The Up-Sampler

The up-sampler 50 performs a ten times up-sampling of the residual signal by conventional band-limited interpolation, where the band-limitation is one-half the sampling frequency (e.g., 4,000 Hz). The up-sampled output signal is provided to the pulse locator 60.

6. The Pulse Locator

Pulse locator 60 determines the location of the pitch-pulse closest to the frame boundary lying between the current and next frames of the up-sampled residual speech signal (i.e., boundary $FB_{n+1}$, between frames $F_n$ and $F_{n+1}$). The location of this pitch-pulse (boundary pulse) is provided to the pitch-cycle extractor 70 which uses this location as the basis for extracting a prototype pitch-cycle waveform.

Figure 6:
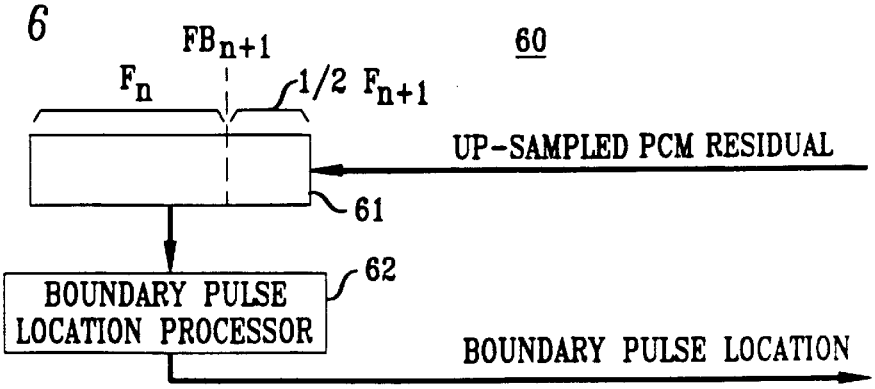
FIG. 6 presents the pulse locator of FIG. 1.

FIG. 6 presents the pulse locator 60 of FIG. 1. Pulse locator 60 comprises a buffer 61 for storing samples from up-sampler 50, and a boundary pulse location processor 62 which operates in accordance with the procedure presented in FIG. 7. Pulse location processor 62 receives from buffer 61 the up-sampled residual signal for the current frame and half of the next frame. At the outset, processor 62 identifies the one sample in the current frame having the greatest absolute amplitude value. The location of this sample is an estimate of the location of the center of one pitch-pulse in the current frame, $F_n$, of up-sampled data.

Next, each subsequent pitch-pulse in the frame $F_n$ is located by processor 62. As may be seen from FIG. 7, processor 62 forms a preliminary estimate of the location of a subsequent pitch-pulse by adding the estimated pitch-period, p, from estimator 40 and the location of the last located pitch-pulse. A localized sample region around the preliminary estimate of the pitch-pulse location (e.g., $\pm\frac{1}{4}p_{n+1}$) is searched by processor 62 to identify the sample therein having the greatest absolute amplitude value. This identified sample is a refined estimate of the location the center of the next pitch-pulse.

Once the location of the pitch-pulse within the current frame, $F_n$, closest to the current/next boundary, $FB_{n+1}$, is determined, processor 62 checks to see whether it must determine the location of the first pitch-pulse in the next frame, $F_{n+1}$. This check involves determining the distance between the determined closest pulse in frame $F_n$ and boundary $FB_{n+1}$, and comparing this distance to $\frac{1}{2}p_{n+1}$. If this distance is less than or equal to $\frac{1}{2}p_{n+1}$, no pitch-pulse location determination in frame $F_{n+1}$ is required. The closest pulse in frame $F_n$ serves as the boundary pulse. If this distance is greater than $\frac{1}{2}p_{n+1}$, the location of the first pitch-pulse in frame $F_{n+1}$ is determined.

Figure 7:
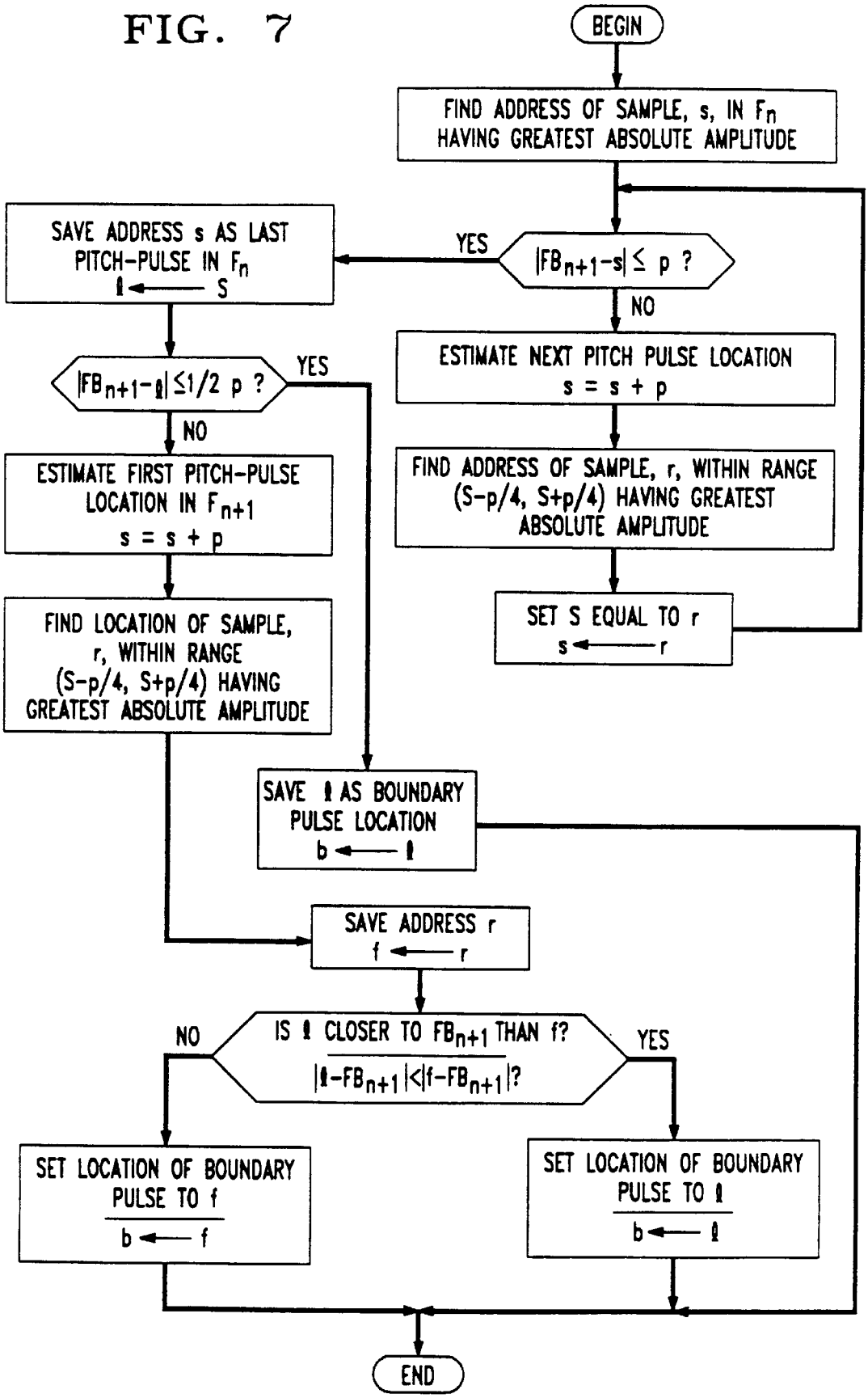
FIG. 7 presents a flow-chart procedure describing the operation of the pulse locator of FIG. 6.

The location of the first pitch-pulse in frame $F_{n+1}$ is determined with a further application of the procedure referenced above as shown in FIG. 7, using samples from the first two sub-frames of the residual signal for frame $F_{n+1}$ (up-sampled to 800 samples and stored in buffer 61). Once the pitch-pulses closest to the current/next frame boundary, $FB_{n+1}$, in both the current and the next frame are identified, processor 62 selects the closer of these to be the boundary pulse.

Regardless of how it is determined, the boundary pulse resides at the center of a pitch-cycle suitable for use as a prototype waveform. The location of the residual signal sample (non-up-sampled) nearest the location of the center of the boundary pulse is output to the pitch-cycle extractor 70.

6. The Pitch-Cycle Extractor

The pitch-cycle extractor 70 comprises a buffer for storing samples from the current and next residual signal frames. From this buffer a set of samples is extracted which serves as a prototype waveform for communication to a speech decoder. This set of samples is selected with reference to the residual signal sample location supplied by the pitch-pulse detector 60 to identify a boundary pulse. The set of extracted samples consists illustratively of all samples located within $\pm\frac{1}{2}p_{n+1}$ of the supplied boundary pulse location. This set of samples defines a prototype waveform associated with (or valid at) the current/next frame boundary, $FB_{n+1}$. If the boundary pulse is located in frame $FB_{n+1}$ and is less than $\frac{1}{2}p_{n+1}$ samples from the end of the available samples in the buffer, the extracted samples are padded with zeros to provide a prototype waveform of length p samples.

At this point, the extracted prototype waveform may be encoded in either the time or frequency domain for transmission to a decoder. What follows are the details of an illustrative frequency domain approach. In light of the following, the time domain approach will be apparent to one of ordinary skill in the art.

7. The Discrete Fourier Transform Processor

The discrete Fourier transform (DFT) processor 80 is a conventional DFT processor which computes a set of complex DFT coefficients based on the extracted residual samples (which form the prototype waveform). The complex coefficients corresponding to frequencies between zero and the Nyquist frequency are output to quantizer 90 as a vector, S, of coefficient pairs. The first coefficient of each pair comprises the real portion of a complex DFT coefficient, and the second coefficient of each pair comprises the negation of the imaginary portion of each DFT coefficient. The vector is indexed by j, the harmonic frequency index:

$$S=\{A(1), B(1); A(2); B(2); \ldots ;A(J),B(J)\}, \tag{2}$$

where J is the index of the highest harmonic frequency in the signal.

As will be discussed below in connection with the decoder 105, these vectors of Fourier series coefficients are used to represent a pitch-cycle waveform as a Fourier series of the general form:

$$\sum_j A(j)\cos(j\phi(t)) + B(j)\sin(j\phi(t)), \tag{3}$$

where j indexes the prototype frequency harmonics, $\phi(t)=2\pi ft$, and $f=1/p$. In (3), A(j) comprises the real portion of a DFT coefficient at the jth frequency harmonic; B(j) comprises the negative of the imaginary portion of the of the DFT coefficient at the jth frequency harmonic.

8. The Quantizer

Figure 8:
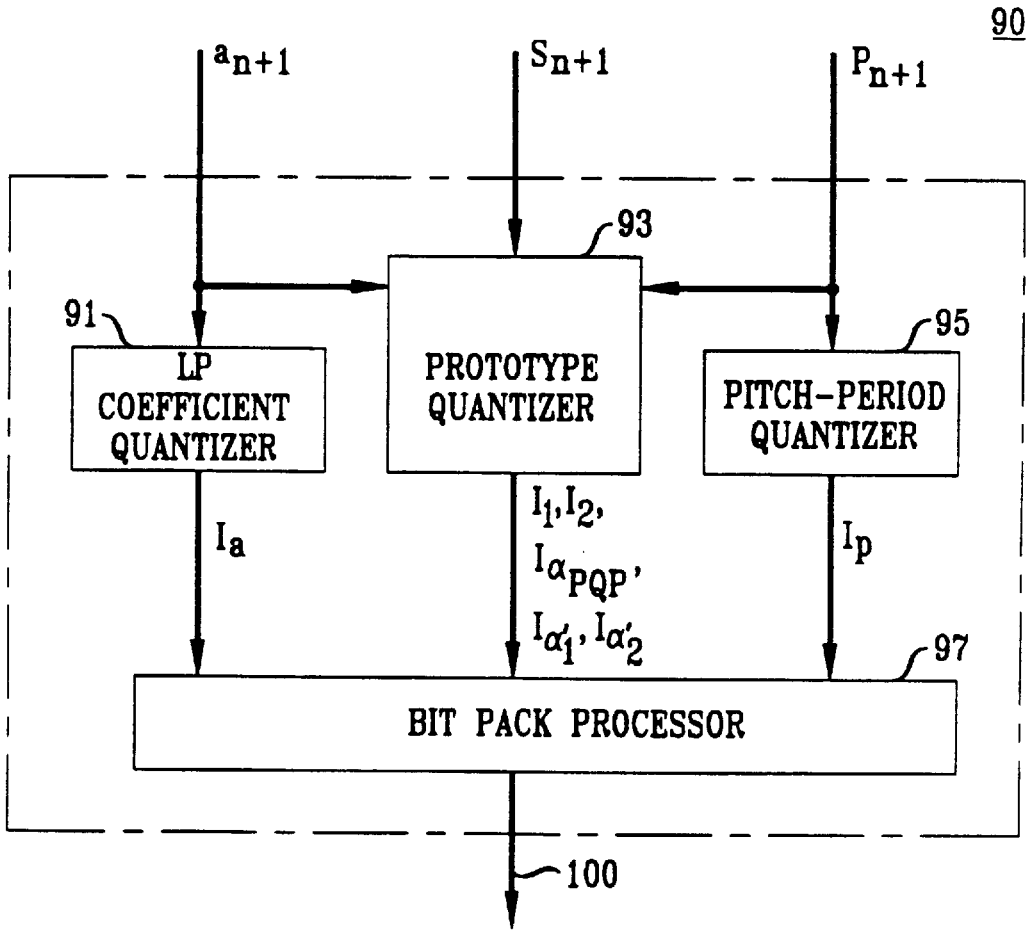
FIG. 8 presents an illustrative quantizer shown in FIG. 1.

FIG. 8 presents the illustrative quantizer 90 of FIG. 1. Quantizer 90 comprises an LP coefficient quantizer 91, a prototype quantizer 93, a pitch-period quantizer 95, and a bit-pack processor 97. Quantizer 90 receives a vector of LP coefficients valid at the same frame boundary, e.g., $a_{n+1}$ valid at $FB_{n+1}$, from linear prediction analyzer 10, a vector of DFT (i.e., Fourier series) coefficients valid at the same frame boundary, e.g., $S_{n+1}$, from Fourier transform processor 80, and a pitch-period scalar, also valid at the same frame boundary, e.g., $p_{n+1}$, from pitch-period estimator 40. Quantizer 90 quantizes these signals to a set of indices, packs the quantization indices into a packet of bits, and transmits the packet to a receiver via channel 100. When channel 100 comprises a storage medium such as those described above, the transmission of this packet over the channel comprises storage of such signals on the medium.

a. The LP Coefficient Quantizer

LP coefficient quantizer 91 receives a vector of LP coefficients, $a_{n+1}$, and quantizes it in the line spectral frequency (LSF) domain (referenced above) in a conventional manner well known in the art. Quantizer 91 may be realized as a vector quantizer, e.g., see K. K. Paliwal and B. S. Atal, *Efficient Vector Quantization of LPC Parameters at* 24 *Bits/Frame,* Proc. Int. Conf. Acoust. Speech and Sign. Process. 160–63 (1991), or a scalar quantizer, e.g., see G. S. Kang and L. J. Fransen, *Low Bit-Rate Speech Encoders Based on Line-Spectrum Frequencies* (*LSFs*), Report Naval Research Laboratory (Jan. 24, 1985). In either case, the output of quantizer 91 is a set bits which form a quantizer index, $I_a$, to be packed and transmitted by processor 97.

b. The Pitch-Period Quantizer

Pitch-period quantizer 95 receives a pitch-period scalar, $p_{n+1}$, and quantizes it with the use of a look-up table. Typically, $p_{n+1}$ takes on values between 20 and 147 samples. A look-up table stored in memory of quantizer 95 associates, e.g., integer values between 20 and 147 to seven bit index values, $I_p$, between [0000000] (equivalent to decimal value 0) and [1111111] (equivalent to decimal value 127):

| $P_{n+1}$ | $I_p$ | $I_p$ (decimal) |
|---|---|---|
| 20 | 0000000 | (0) |
| 21 | 0000001 | (1) |
| 22 | 0000010 | (2) |
| . | . | . |
| . | . | . |
| . | . | . |
| 147 | 1111111 | (127) |

Values, $I_p$, from the table are provided by quantizer 95 to processor 97 for packing and transmission.

c. The Prototype Quantizer

Figure 9:
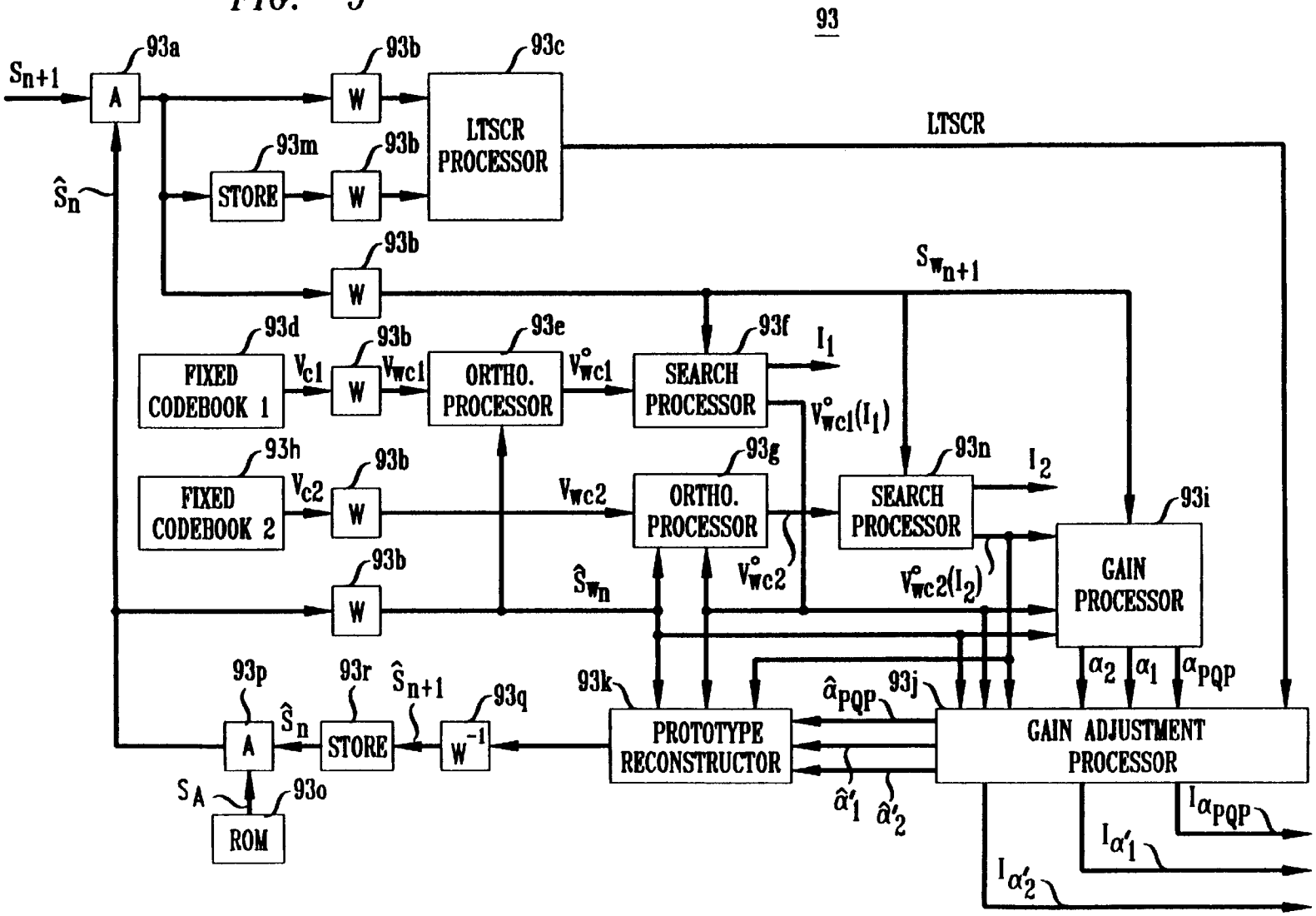
FIG. 9 presents an illustrative prototype quantizer shown in FIG. 8.

FIG. 9 presents the illustrative prototype quantizer 93 of FIG. 8. Quantizer 93 is a system of two vector quantizers and three scalar quantizers which are used to represent Fourier series coefficients of a given prototype waveform valid at, e.g., $FB_{n+1}$, received from DFT processor 80. This system of quantizers produces five quantization indices—$I_1$, $I_2$,$I_{\alpha_{PQP}}$, $I_{\alpha_1}$, and $I_{\alpha_2}$—for output to the bit-pack processor 97.

Prior to describing in detail the structure of quantizer 93, it will be advantageous to describe the long-term signal-to-change ratio (LTSCR)—a factor computed and used by the quantizer 93 to adjust quantization gains.

The signal-to-change ratio (SCR) is a measure of the similarity of shape of two prototype waveforms. Generally, it may be viewed as a ratio of the prototypes' similar and dissimilar squared energies. For two given prototypes, $S_1$ and $S_2$, where S is a vector of the form [A(0), B(0); A(1), B(1); . . . ; A(N), B(N)], the SCR is defined as:

$$SCR = \left[ 1 - \frac{(S_1^T \Lambda S_2)^2}{S_1^T \Lambda S_1 S_2^T \Lambda S_2} \right]^{-1}, \tag{4}$$

where Λ is a diagonal matrix with unity values along the diagonal for desired harmonics and zero everywhere else. Matrix Λ allows a selective determination of SCR in terms of frequency. That is, since prototypes are described in terms of Fourier series components, the SCR for prototype waveforms may be determined as a function of harmonic frequency. The SCR may be computed for entire prototypes, or any desired subset of prototype harmonics.

The LTSCR is an SCR computed for prototype waveforms separated in time by one frame, e.g., $F_n$. As such, e.g., $S_1$ is a prototype valid at frame boundary $FB_n$ (i.e., $S_n$), while $S_2$ is a prototype valid at frame boundary $FB_{n+1}$ (i.e., $S_{n+1}$). LTSCR is significant because without preventive action, the shape "change" between consecutive unquantized prototypes (i.e., consecutive prototypes prior to quantization by the encoder 5) would be smaller than the shape "change" between the corresponding two estimated prototypes recovered by the decoder 105. As such, LTSCR for a pair of prototypes at the decoder would be smaller than that computed for the corresponding uncoded pair at the encoder. This difference in LTSCR can manifest itself as a reverberation in the speech synthesized by the decoder 105.

In order to reduce the reverberant qualities of synthesized speech, the prototype quantizer 93 adjusts the value of vector quantization codebook gains so that the LTSCR of consecutive prototypes synthesized at the decoder 105 is the same as that computed for corresponding unquantized prototypes at the encoder 5. This adjustment is provided by the gain adjustment processor 93*j* of processor 93 (see below).

i. The Prototype Alignment Processor

Referring again to FIG. 9, consider the quantization of a prototype valid at frame boundary $FB_{n+1}$, $S_{n+1}$,provided to quantizer 93 from Fourier transform processor 80. At the outset, this prototype is aligned with an estimate of the previous quantized prototype (PQP), $\hat{S}_n$, by alignment processor 93*a*. This $\hat{S}_n$ is a replica of the previous prototype as it would be synthesized by decoder 105.

In general, processor 93*a* determines a phase shift, ξ, for a prototype $S_{n+1}$ based on Fourier series coefficients $\{A_{n+1}(j), B_{n+1}(j)\}$ so as to align it with a prototype $\hat{S}_n$ based on Fourier-series coefficients $\{\hat{A}_n(j), \hat{B}_n(j)\}$. The phase shift ξ is that shift applied to coefficients of $S_{n+1}$ which minimizes a distortion measure relating the two prototypes (see 132 in FIG. 10):

$$\xi = \underset{\xi'}{\operatorname{argmax}} \sum_{j=1}^{J} (A_{n+1}(j)\hat{A}_n(j) + B_{n+1}(j)\hat{B}_n(j))\cos(j\xi') + (B_{n+1}(j)\hat{A}_n(j) - A_{n+1}(j)\hat{B}_n(j))\sin(j\xi'), \tag{5}$$

where J is the total number of harmonics in the band-limited Fourier series, and ξ' is a trial value of ξ within a range of 0 to 2π. A multitude of ξ' within the range are tried to determine which yields the minimum distortion between the two prototypes.

Figure 11:
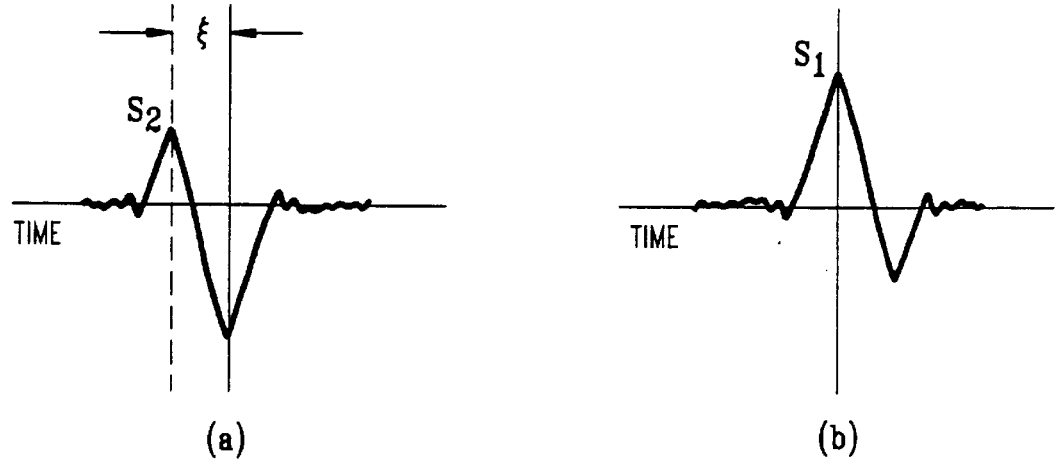
FIG. 11 presents a pitch-cycle for each of two prototype waveforms.

Graphically, the determination of a value for ξ may be understood with reference to FIG. 11. The prototypes $S_{n+1}$ and $\hat{S}_n$ are shown with their maximum absolute values centered in a sub-frame. Prototype $S_{n+1}$ is centered about its maximum absolute value which is negative. Prototype $\hat{S}_n$ is centered about its maximum absolute value which is positive. Each prototype has a penultimate peak adjacent to its maximum absolute value with opposite sign.

The phase differential, ξ, between consecutive prototype waveforms is the phase shift required to align the major positive (or negative) peak of prototype $S_{n+1}$ with the major positive (or negative) peak of the other prototype, $\hat{S}_n$. This phase shift usually entails aligning the pitch-pulses. In the example of FIG. 11, because the largest pulse of prototype $S_{n+1}$ is negative and that of prototype $\hat{S}_n$ is positive, the alignment may be seen as the phase shift required to align the major positive peak of prototype $S_{n+1}$ with the largest absolute maximum of prototype $\hat{S}_n$.

The shift of prototype $S_{n+1}$ to the right by an amount ξ requires additional prototype signal samples shifted in from the left side of the sub-frame. Because prototypes constructed at a receiver are based upon communicated Fourier series coefficients, the requirement for additional samples presents no difficulty. That is, because the communicated Fourier series coefficients describe a periodic signal one period of which (i.e., 2π) is the prototype in question, the additional samples needed for the shift may comprise samples from an adjacent pitch-cycle of the Fourier series. In the example of FIG. 11, ξ=+0.3 π.

With an alignment value, ξ, determined, Fourier series coefficients for an aligned prototype $S_{n+1}$ are determined by processor 130 according to the following procedure (see 134 in FIG. 10):

$$\tilde{A}_{n+1}(j)=A_{n+1}(j)\cos(j\xi)-B_{n+1}(j)\sin(j\xi);\ \tilde{B}_{n+1}(j)=A_{n+1}(j)\sin(j\xi)+B_{n+1}(j)\cos(j\xi), \tag{6}$$

$1 \leqq j \leqq J$ (the "~" associated with aligned Fourier series coefficients will be dropped from further use without confusion).

The output of the prototype alignment processor 93*a* is provided to SCR processor 93*c* and gain processor 93*i* via weighting processors 93*b*, and also through a delay storage memory 93*m*.

ii. The Weighting Processor

The weighting processor 93*b* receives as input a vector of Fourier series coefficients representing, e.g., a prototype $S_{n+1}$, and provides a vector of spectrally weighted Fourier series coefficients as output. For example, if the input vector of Fourier series coefficients is $S_{n+1}$=[A(0), B(0); A(1), B(1); . . . ; A(J), B(J)], then a spectrally weighted version of the vector, $S_{w_{n+1}}$=[$A_w$(0), $B_w$(0); $A_w$(1), $B_w$(1); . . . ; $A_w$(J), $B_w$(J)] is provided by the processor 93*b* as follows:

$$A_w(j) = \frac{A(j)\sum_{k=0}^{N}\gamma^k a_k\cos\left(\frac{2\pi jkT}{p}\right) + B(j)\sum_{k=0}^{N}\gamma^k a_k\sin\left(\frac{2\pi jkT}{p}\right)}{\left(\sum_{k=0}^{N}\gamma^k a_k\cos\left(\frac{2\pi jkT}{p}\right)\right)^2 + \left(\sum_{k=0}^{N}\gamma^k a_k\sin\left(\frac{2\pi jkT}{p}\right)\right)^2} \tag{7}$$

$$B_w(j) = \frac{-A(j)\sum_{k=0}^{N}\gamma^k a_k\sin\left(\frac{2\pi jkT}{p}\right) + B(j)\sum_{k=0}^{N}\gamma^k a_k\cos\left(\frac{2\pi jkT}{p}\right)}{\left(\sum_{k=0}^{N}\gamma^k a_k\cos\left(\frac{2\pi jkT}{p}\right)\right)^2 + \left(\sum_{k=0}^{N}\gamma^k a_k\sin\left(\frac{2\pi jkT}{p}\right)\right)^2},$$

for $0 \leqq j \leqq J$, where γ is a perceptual weighting factor equal to, e.g., 0.8, and $a_k$ and p are the LP coefficients and the pitch-period, respectively, valid at the same time as the prototype Fourier series coefficients A and B. The procedure is equivalent to applying an all-pole filter on the periodic sampled time-domain signal described by the Fourier series. Use of the factor γ moves the poles of an LP filter inward producing an associated spectral flattening. This results in a decreased weight on the distortion near spectral peaks, which is consistent with frequency-domain masking effects observed for the human auditory system.

The weighting processor 93*b* provides a vector of weighted Fourier series coefficients [$A_w$(j),$B_w$(j)] as output. As shown in FIG. 9, weighting processor 93*b* is used in several places to convert Fourier series coefficients to the spectrally weighted domain.

iii. The LTSCR Processor

The LTSCR processor 93*c* receives consecutive spectrally weighted vectors of Fourier series coefficients, and determines the LTSCR of the prototypes these vectors represent. The LTSCR is computed according to expression (4) as follows:

$$LTSCR = \left[1 - \frac{(S_{w_n}^T \Lambda S_{w_{n+1}})^2}{S_{w_n}^T \Lambda S_{w_n} S_{w_{n+1}}^T \Lambda S_{w_{n+1}}}\right]^{-1}, \tag{8}$$

where $S_{w_{n+1}}$ represents a vector of weighted Fourier series coefficients valid at, e.g., $FB_{n+1}$, $S_{w_n}$ represents a vector of weighted Fourier series coefficients valid at, e.g., $FB_n$, and Λ is a diagonal matrix with unity values inserted to select the desired frequency band. Although the LTSCR varies with frequency, which makes separate determination for multiple frequency bands relevant, a single LTSCR value comprising the entire signal bandwidth provides useful performance. Usage of a single band has the advantage that no additional information need be transmitted. In this case, the LTSCR processor 93*c* provides the LTSCR scalar as output to gain adjustment processor 93*j*.

iv. The First Fixed Codebook

The fixed codebook 93*d* is a codebook of Fourier series coefficient vectors, each of which, $V_{c1}$, may represent (in the time domain) a single band-limited pulse centered in a pitch-period of normalized length. Codebook 93*d* may comprise, e.g., 128 vectors. Vectors of coefficients from codebook 93*d* are provided as output to an orthogonalization processor 93*e* via a weighting processor 93*b*.

Training for this codebook is done by taking advantage of the fact that the extracted prototype waveform has its pitch-pulse (i.e., most of its energy) centered in its pitch-period. The centering of the pitch-pulse in the prototype waveform is a direct result of the manner in which the prototype waveforms are aligned as will be seen below. Because the pitch-pulse is known to be near the center of the prototype, the first fixed codebook 93*d* codebook need not account for large variation in pitch-pulse position within a frame, and hence may be built with fewer vectors. As such, fewer bits are needed to represent entries of the codebook. This has an overall effect of reducing bit rate. Training may be accomplished by performing the DFT of the training samples as described above, and performing conventional clustering techniques (e.g., k-means clustering) to provide the codebook vectors.

v. The First Orthogonalization Processor

The orthogonalization processor 93*e* modifies weighted vectors from the first fixed codebook 93*d*, $V_{wc1}$, so as to be orthogonal to the estimated PQP vector in the weighted domain, $\hat{S}_{w_n}$. This is done by subtracting from $V_{wc1}$ the projection of $V_{wc1}$ onto the line through the estimated PQP vector. Both the codebook and PQP vectors comprise Fourier series coefficients of the form $[A_w(0), B_w(0); A_w(1), B_w(1); \ldots; A_w(J), B_w(J)]$, where $A_w$ is a weighted coefficient of a cosinusoid in a Fourier series, and $B_w$ is a weighted coefficient of a sinusoid in a Fourier series. A weighted vector from the first fixed codebook, $V_{wc1}$, is made orthogonal to a weighted PQP vector, $\hat{S}_{w_n}$, as follows:

$$V^o_{wc1} = V_{wc1} - \frac{V^T_{wc1}\hat{S}_{w_n}}{\hat{S}^T_{w_n}\hat{S}_{w_n}}\ \hat{S}_{w_n}, \tag{9}$$

for each weighted codebook 93*d* vector, where $V_{wc1}{}^o$ is an orthogonalized version of $V_{wc1}$. The output of the orthogonalization processor 93*e* comprises orthogonalized codebook vectors for use by search processor 93*f*.

vi. The Search Processor

The search processor 93*f* operates to determine which of the spectrally weighted orthogonalized codebook vectors, $V_{wc1}{}^o$, most closely matches in shape (in a least squared error sense) the original prototype, weighted by weighting processor 93*b*, $S_{w_{n+1}}$. Search processor 93*f* may be realized in conventional fashion common to analysis-by-synthesis coders, such as code-excited linear prediction (CELP) coders. Shape matching is accomplished by using the optional scaling factor for the codebook vector, $$\frac{V^T_{wc1}S_{w_{n+1}}}{S^T_{w_{n+1}}S_{w_{n+1}}},$$

when the error criterion is evaluated. Search processor 93*f* produces two outputs: (1) an index $I_1$ identifying the vector in the first fixed codebook 93*d* (as processed by processors 93*b* and *e*) which most closely matches the original weighted prototype, $S_{w_{n+1}}$, in shape, and (2) the weighted, orthogonalized vector itself, $V_{wc1}{}^o$, $(I_1)$. The index $I_1$ is provided to bit-pack processor 97 for transmission to the decoder 105 via channel 100. The vector $V_{wc1}{}^o(I_1)$ is provided to prototype reconstructor 93*k*, orthogonalization processor 93*g*, and gain processor 93*i*.

vii. The Second Fixed Codebook

The fixed codebook 93*h* of prototype quantizer 93, like codebook 93*d*, provides a set of vectors used in quantizing the current weighted prototype $S_{w_{n+1}}$. In this case, the vectors may be thought of as quantizing the error remaining after the previously described vector quantization codebook procedure. The vectors stored in this codebook 93*h* comprise Fourier series coefficients which represent (in the time domain) a small set of band-limited pulses, the set being of normalized length. Thus, between codebooks 93*d* and 93*h*, corrections to the pitch-pulse and other signal features in the pitch-cycle of a prototype may be represented. Vectors from codebook 93*h*, $V_{c2}$, are provided as output to orthogonalization processor 93*g* via weighting processor 93*b*.

viii. The Second Orthogonalization Processor

The orthogonalization processor 93*g* modifies weighted vectors, $V_{wc2}$, form the second fixed codebook 93*h* so as to be orthogonal to both the estimated PQP vector in the weighted domain, $\hat{S}_{w_n}$, and the output of search processor 93*f*, $V_{wc1}{}^o(I_1)$. The first and second codebook vectors and the PQP vector comprise Fourier series coefficients of the form $[A_w(0), B_w(0); A_w(1), B_w(1); \ldots; A_w(J), B_w(J)]$, as described above. A weighted vector from the second fixed codebook, $V_{wc2}$, is made orthogonal to vectors $\hat{S}_{w_n}$ and $V_{wc1}{}^o(I_1)$ as follows:

$$V^o_{wc2} = V_{wc2} - \frac{V^T_{wc2}\hat{S}_{w_n}}{\hat{S}^T_{w_n}\hat{S}_{w_n}}\ \hat{S}_{w_n} - \frac{V^T_{wc2}V^o_{wc1}(I_1)}{V^{oT}_{wc1}(I_1)V^o_{wc1}(I_1)}\ V^o_{wc1}(I_1), \tag{10}$$

for each weighted codebook vector, where $V_{wc2}{}^o$ is an orthogonalized version of $V_{wc2}$. The output of the orthogonalization processor 93*g* comprises orthogonalized codebook vectors for use by search processor 93*n*.

ix. The Second Search Processor

The search processor 93*n* operates to determine which of the spectrally weighted orthogonalized codebook vectors, $V_{wc2}{}^o$, most closely matches the original weighted prototype, $S_{w_{n+1}}$. Search processor 93*n* functions exactly the same way as search processor 93*f*. Search processor 93*n* produces two outputs: (1) an index $I_2$ identifying the vector in the second fixed codebook 93*h* (as processed by processors 93*b* and *g*) which most closely matches the original weighted prototype, $S_{w_{n+1}}$, in shape, and (2) the weighted, orthogonalized vector itself, $V_{wc2}{}^o(I_2)$. The index $I_2$ is provided to bit-pack processor 97 for transmission to the receiver via channel 100. The vector $V_{wc2}{}^o(I_2)$ is provided to prototype reconstructor 93*k* and gain processor 93*i*.

x. The Gain Processor

The gain processor 93*i* receives as input the original weighted prototype, $S_{w_{n+1}}$, the vectors from search processors 93*f* and *n*, $V_{wc1}{}^o(I_1)$ and $V_{wc2}{}^o(I_2)$, respectively, and the reconstructed estimate of the previous prototype $\hat{S}_{w_n}$. Based on this input, gain processor 93*i* computes gains $\alpha_{PQP}$, $\alpha_1$, and $\alpha_2$, for vectors $\hat{S}_{w_n}$, $V_{wc1}{}^o(I_1)$ and $V_{wc2}{}^o(I_2)$, respectively. These gains are computed as follows:

$$\alpha_{PQP} = \frac{\hat{S}_{w_n}S_{w_{n+1}}}{\hat{S}^T_{w_n}\hat{S}_{w_n}}\ ; \tag{11}$$

$$\alpha_1 = \frac{V^{oT}_{wc1}S_{w_{n+1}}}{V^{oT}_{wc1}V^o_{wc1}}\ ; \tag{12}$$

and $$\alpha_2 = \frac{V^{oT}_{wc2}S_{w_{n+1}}}{V^{oT}_{wc2}V^o_{wc2}}\ . \tag{13}$$

These gains are scalars which are provided by processor 93*i* to gain adjustment processor 93*j*.

xi. The Gain Adjustment Processor

The gain adjustment processor 93*j* adjusts the gain scalars $\alpha_1$ and $\alpha_2$ provided by gain processor 93*i* in order to allow two successive prototypes reconstructed by the receiver to have the same LTSCR as the associated original successive prototypes. Adjustment can be made as follows.

The initial estimate of the current weighted prototype, $\hat{S}_{w_{n+1}}$, is formed based on the optimal values for the gain scalars, $\alpha_1'$ and $\alpha_2'$:

$$\hat{S}_{w_{n+1}}=\alpha_{PQP}\hat{S}_{w_n}+\alpha_1'V_{wc1}^{o}+\alpha_2'V_{wc2}^{o}. \tag{14}$$

Let a be the contribution from the previous prototype (PQP), and b be the "correction" resulting from the codebooks. Then, $$a=\alpha_{PQP}S_{w_n} \tag{15}$$

$$b=\alpha_1'V_{wc1}^{o}+\alpha_2'V_{wc2}^{o}. \tag{16}$$

The goal is to scale b relative to a so as to obtain the desired LTSCR from processor 93*c*. By setting the LTSCR of the reconstructed signal equal to the LTSCR of the original, $LTSCR_o$, this goal is attained. If $S_{w_{n+1}}=a+\lambda b$, then $$LTSCR_o=\left[1-\frac{[a\Lambda(a+\lambda b)]^2}{a\Lambda a\cdot(a+\lambda b)\Lambda(a+\lambda b)}\right]^{-1}. \tag{17}$$

Therefore, $$\lambda=\sqrt{\frac{a^T\Lambda a}{b^T\Lambda b(LTSCR_o-1)}}, \tag{18}$$

where $LTSCR_o$, is the LTSCR of the original successive prototypes.

By using the value $\lambda$ thus computed, a reconstructed prototype with the correct LTSCR is obtained. The gains $\alpha_1$ and $\alpha_2$ are now adjusted by multiplication by the factor $\lambda$ to yield $\alpha_1'$ and $\alpha_2'$. Advantageously, all scaling factors, $\alpha_{PQP}$, $\alpha_1'$, and $\alpha_2'$ are further scaled by a single factor to make the energy of the reconstructed prototype equal to that of the original prototype waveform.

Next each of scaling factors $\alpha_{PQP}$, $\alpha_1'$, $\alpha_2'$ are quantized by conventional scalar quantization. The resulting quantization indices are supplied to the bit-pack processor 97. The quantized form of these adjusted gains associated with the indices, $\hat{\alpha}_{PQP}$, $\hat{\alpha}_1'$, and $\hat{\alpha}_2'$, are provided to the prototype reconstructor 93*k*, as well.

xii. The Prototype Reconstructor

The prototype reconstructor 93*k* computes an estimate of the current weighted prototype, $\hat{S}_{w_{n+1}}$, based on values from gain adjustment processor 93*j*, a past weighted prototype estimate, and selected codebook vectors:

$$\hat{S}_{w_{n+1}}=\hat{\alpha}_{PQP}\hat{S}_{w_n}+\hat{\alpha}_1'V_{wc1}^{o}+\hat{\alpha}_2'V_{wc2}^{o}. \tag{19}$$

The value of the current weighted prototype, $\hat{S}_{w_{n+1}}$ is provided as output to inverse weighting processor 93*q*.

xiii. The Inverse Weighting Processor

The inverse weighting processor 93*q* removes the spectral weighting of the input value $\hat{S}_{w_{n+1}}$ to provide an unweighted estimate of the current prototype $\hat{S}_{n+1}=\{\hat{A}_w(j), \hat{B}_w(j)\}$:

$$A(j)=\hat{A}_w(j)\sum_{k=0}^{N}\gamma^k a_k\cos\left(\frac{2\pi jkT}{p}\right)- \tag{20}$$

-continued $$\hat{B}_w(j)\sum_{k=0}^{N}\gamma^k a_k\sin\left(\frac{2\pi jkT}{p}\right)$$

$$B(j)=\hat{A}_w(j)\sum_{k=0}^{N}\gamma^k a_k\sin\left(\frac{2\pi jkT}{p}\right)+$$

$$\hat{B}_w(j)\sum_{k=0}^{N}\gamma^k a_k\cos\left(\frac{2\pi jkT}{p}\right),$$

for $0\leqq j\leqq J$, where $\gamma$ takes on the value used by weighting processor 93*b*, and $a_k$ and p are the LP coefficients and the pitch-period valid at the same time as the weighted prototype Fourier series coefficients, $\hat{A}_w$, $\hat{B}_w$. The output of processor 93*q*—vector $\hat{S}_{n+1}$—is provided to alignment processor 93*p* via delay store 93*r*.

xiv. The Second Alignment Processor

The alignment processor 93*p* receives a delayed version of prototype $\hat{S}_{n+1}$, i.e., $\hat{S}_n$, and aligns it with a prototype having a single pitch-pulse at the center of a pitch period of normalized length, $S_A$. Prototype $S_A$ comprises Fourier series coefficients representing a single, centered pitch-pulse. These coefficients are stored in read-only memory (ROM) 93*o*. The sign of the pulse is identical to the maximum valve of the prototype waveform $\hat{S}_n$. The purpose of the present alignment is to maintain the pitch-pulse in the center of the prototype so as to increase the efficiency of the quantization. The processing performed by alignment processor 93*p* is the same as that described above for alignment processor 93*a*, save the differences in input, and hence output, signals. The output of alignment processor 93*p*, $\hat{S}_n$, is provided to alignment processor 93*a*, as well as orthogonalization processors 93*e* and *g*, prototype reconstructor 93*k* and the gain and gain adjustment processors, 93*i* and *j*, respectively.

d. The Bit Pack Processor

Bit pack processor 97 receives indices from LP coefficient quantizer 91 (i.e., $I_a$, comprising, e.g., twenty-four bits), prototype quantizer 93 (i.e., $I_1$, $I_2$, $I_{\alpha_{PQP}}$, $I_{\alpha_1}$, and $I_{\alpha_2}$, comprising, e.g., 7, 7, 5, 6 and 6 bits, respectively), and pitch-period quantizer 95 (i.e., $I_p$, comprising, e.g., seven bits) and packs these indices in a packet for transmission to a receiver. Each packet comprises indices valid at a frame boundary, e.g., $FB_{n+1}$. Processor 97 may be realized in conventional fashion to load contiguous bit locations in memory with bits reflecting the indices. The loading of index bits is performed in a predefined format (such as an order of bits reflecting an index order $I_a$, $I_1$, $I_2$, $I_{\alpha_{PQP}}$, $I_{\alpha_1}$, and $I_{\alpha_2}$) known both to processor 97 and to the decoder (see the description of the received packet processor 112, below). Once loaded, this region of memory is written to an output port of processor 97 for transmission via channel 100.

C. Decoder

Figure 12:
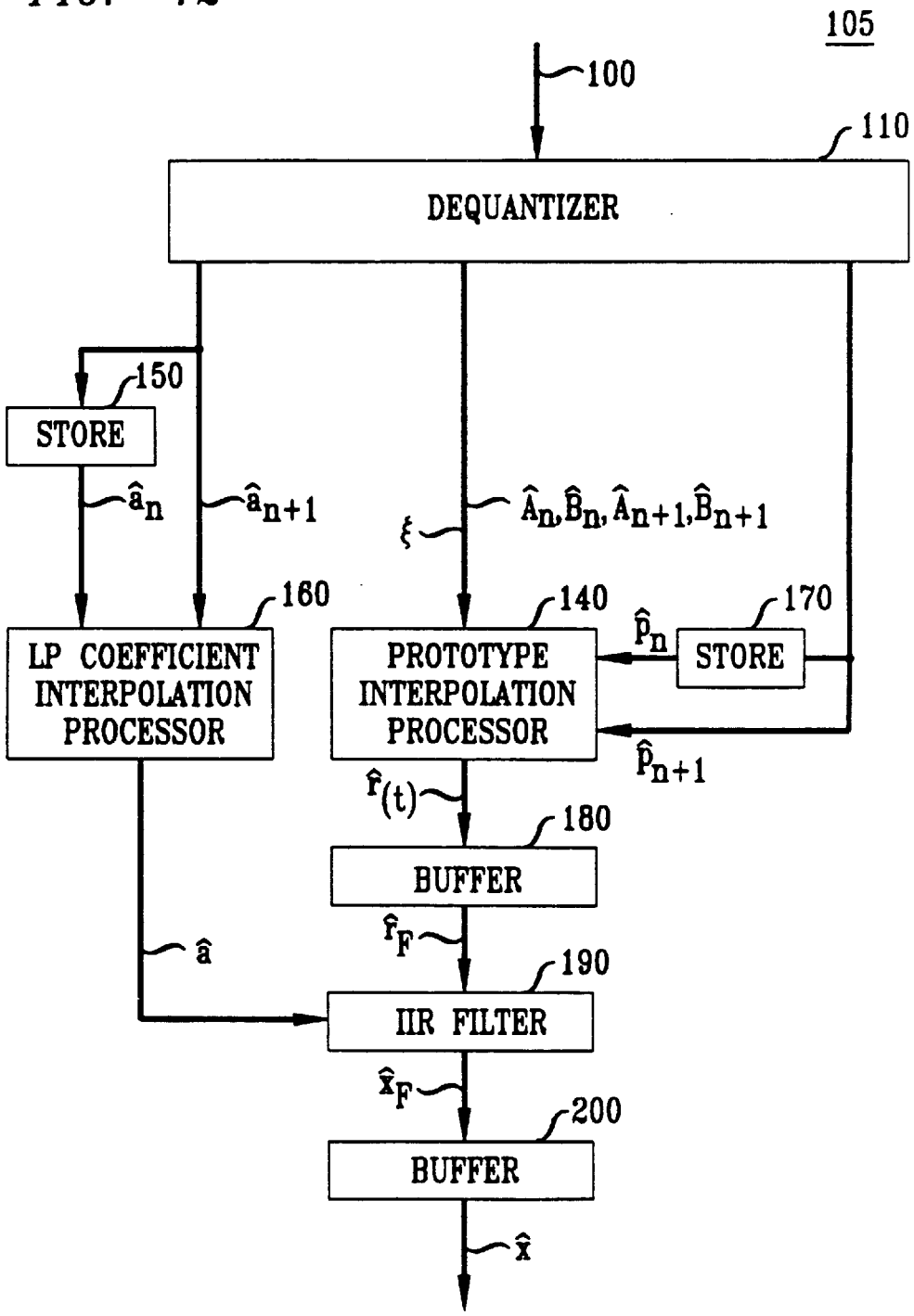
FIG. 12 presents an illustrative embodiment of a decoder according to the present invention.

An illustrative embodiment of a decoder 105 according to the present invention is presented in FIG. 12. As shown in the Figure, decoder 105 receives coded speech signals from channel 100, and provides frames of reconstructed speech, $\hat{x}_F$, as output. Decoder 105 comprises a dequantizer 110, a prototype store 120, a prototype interpolation processor 140, an LP coefficient store 150, an LP coefficient interpolation processor 160, a pitch-period store 170, a reconstructed residual buffer 180, and an infinite impulse response (IIR) digital filter 190.

As described above with reference to the pulse locator 60 and pitch-cycle extractor 70 of the encoder 5, the received Fourier series coefficients for a prototype waveform are actually valid somewhere within an interval beginning just before and ending just after a frame boundary. For purposes of the decoder 105, these coefficients will be presumed to be valid at the frame boundary.

1. The Dequantizer

Figure 13:
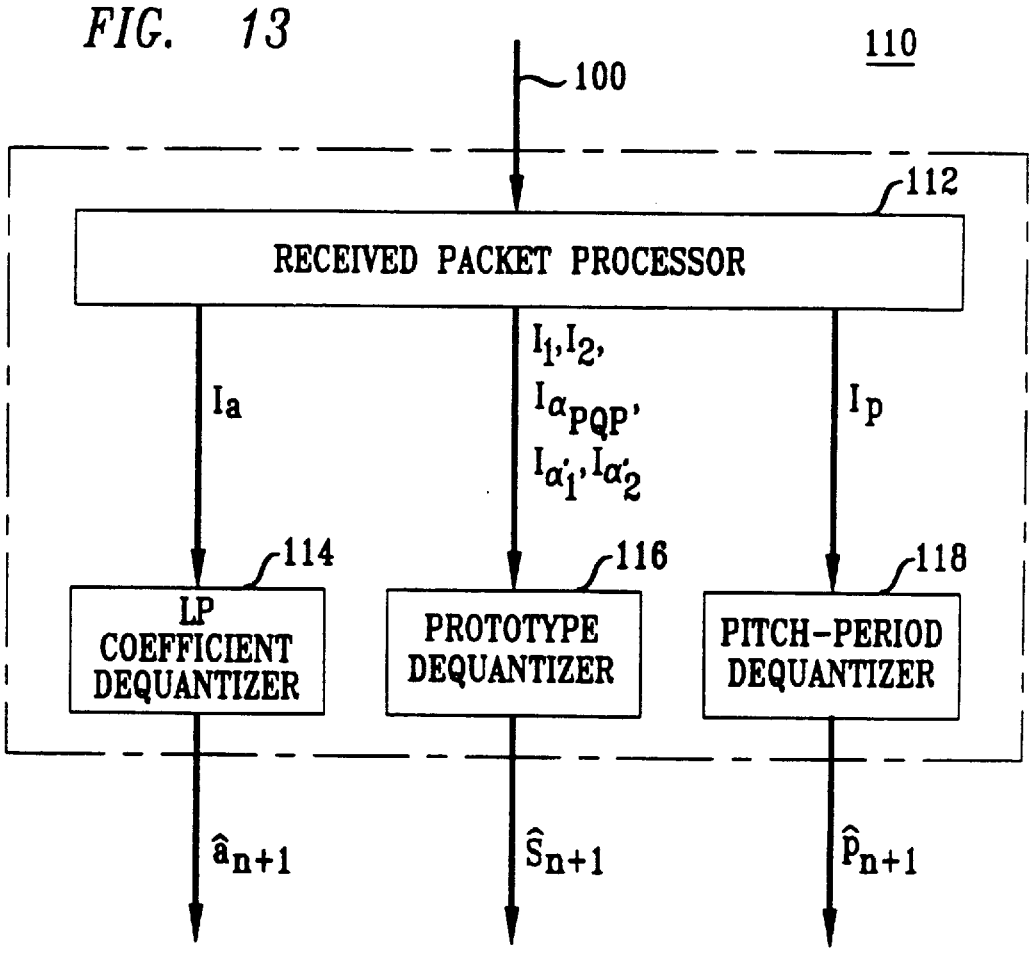
FIG. 13 presents a dequantizer shown in FIG. 12.

FIG. 13 presents the dequantizer 110 shown in FIG. 12. As shown in the Figure, the dequantizer comprises a received packet processor 112, an LP coefficient dequantizer 114, a prototype dequantizer 116, and a pitch-period dequantizer 118. The dequantizer 110 receives coded speech signals from channel 100 in the form of packets, extracts individual indices from received packets, and generates digital signals representing LP coefficients, prototypes, and pitch-periods through vector dequantization of the indices.

a. Received Packet Processor

The received packet processor 112 receives packets of coded speech and extracts from each packet the indices associated with the vector quantization of the speech. As such, processor 112 performs the inverse operation of the bit pack processor 97.

Processor 112 may be realized in conventional fashion. Given a predefined association or format of packet bits and individual quantization indices (e.g., that described above with reference to the operation of the bit pack processor 97), processor 112 isolates a given index by reading those portions of the received packet (i.e., those bits) associated with the index. This association may be realized with a conventional bit masking procedure. The bit mask acts as a template which isolates only those bits of interest for a given index. Once read, an index is provided as output to the appropriate processor.

Thus, processor 112 reads those bits in the packet associated with $I_{60}$, and provides these bits as an input index to LP coefficient dequantizer 114. Processor 112 reads those bits in the packet associated with each of $I_1$,$I_2$,$I_{\alpha_{PQP}}$, $I_{\alpha_1}$, and $I_{\alpha_2}$, and provides these bits in the form of individual indices to the prototype dequantizer 116. Finally, processor 116 reads those bits in the packet associated with $I_p$, and provides these bits as an index to pitch-period dequantizer 118.

b. The LP Coefficient Dequantizer

The LP coefficient dequantizer 114 performs the inverse of the operation of LP coefficient quantizer 91 discussed above. Dequantizer 114 receives an index, $I_a$, from received packet processor 112 and selects a set of LSFs based on the index. The set of LSFs is provided by a table stored in memory and indexed by $I_a$. The set of LSFs is converted by conventional techniques (see the references cited above) into a vector of LP coefficients valid at a frame boundary, e.g., coefficients $\hat{a}_{n+1}$ valid at frame boundary $FB_{n+1}$. These coefficients $\hat{a}_{n+1}$ are an estimate of the original coefficients $a_{n+1}$, coded by quantizer 91.

c. The Pitch-Period Dequantizer

The pitch-period dequantizer 118 performs the inverse of the operation of the pitch-period quantizer 95 discussed above. The pitch-period dequantizer 118 receives an index, $I_p$ from processor 112 and selects a pitch-period based on the index. A table of pitch-periods equivalent to that presented above in the discussion of quantizer 95 is stored in memory and is indexed by values $I_p$. When an index $I_p$ is received by dequantizer 118 from processor 112, the table is scanned to select a pitch-period value valid at a frame boundary, e.g., coefficients $\hat{p}_{n+1}$ valid at frame boundary $FB_{n+1}$. This selected pitch-period value is an estimate of the original pitch-period $p_{n+1}$ coded by quantizer 95.

d. The Prototype Dequantizer

Figure 14:
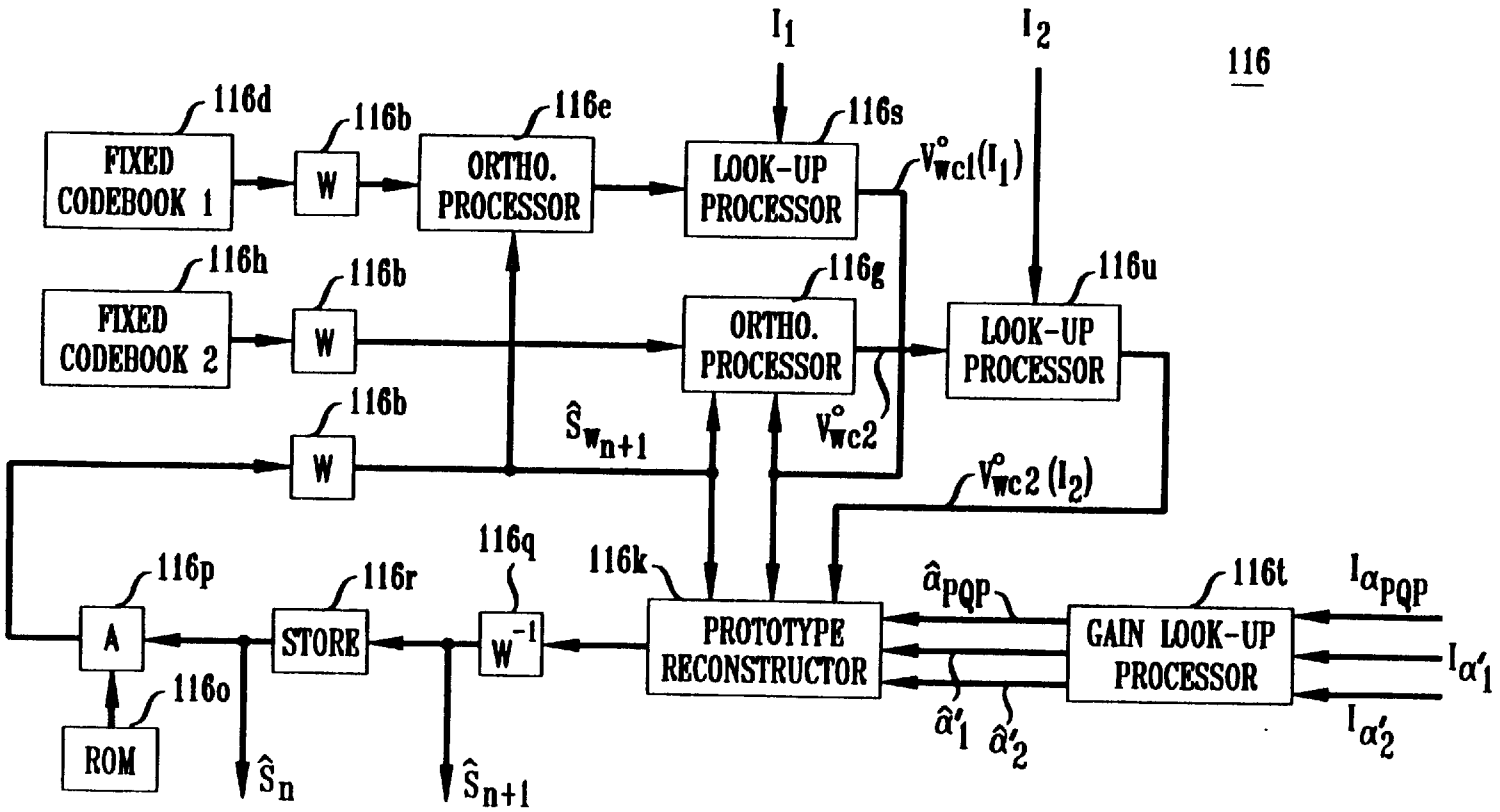
FIG. 14 presents a prototype dequantizer shown in FIG. 13.

FIG. 14 presents the illustrative prototype dequantizer 116 shown in FIG. 12. The prototype dequantizer 116 receives a plurality of indices from received packet processor 112 and provides as output a prototype valid at e.g., frame boundary $FB_{n+1}$: $\hat{S}_{n+1}$. Prototype $\hat{S}_{n+1}$ is an estimate of prototype $S_{n+1}$ encoded by prototype quantizer 93.

The components and operation of the prototype dequantized 116 are very similar to whole sections of the prototype quantizer 93. Because of this similarity, certain elements of the quantizer and dequantizer which perform the same tasks in the same way have the identical drawing figure labeling. Moreover, drawing figure reference marks to these elements are indicated with the same lower case letter suffix. For example, both the quantizer 93 and the dequantizer 116 employ identical codebooks labeled "Fixed Codebook 1 " in both FIGS. 9 and 13, respectively. The reference marks for these codebooks are 93*d* and 116*d,* respectively. For the sake of clarity, no further detailed discussion of the operation of these elements is presented.

The main function of dequantizer 116 is the generation of a prototype waveform $\hat{S}_{n+1}$. As shown in FIG. 13, this is accomplished proximately by prototype reconstructor 116*k* and inverse weighting processor 116*q*. As described above, prototype reconstructor 116*k* determines a weighted estimate of this prototype according to the following expression (also presented above):

$$\hat{S}_{w_{n+1}}=\hat{\alpha}_{PQP}\hat{S}_{w_n}+\hat{\alpha}_1{}'V_{wc1}{}^{o}+\hat{\alpha}_2{}'V_{wc2}{}^{o}. \tag{21}$$

The balance of the prototype dequantizer is essentially dedicated to providing values for this expression (21). Gain look-up processor 116*t* receives indices $I_{\alpha_{PQP}}$, $I_{\alpha_1}$, and $I_{\alpha_2}$, and, with conventional table look-up operations, determines the values for $\hat{\alpha}_{PQP}$, $\hat{\alpha}_1$, and $\hat{\alpha}_2$.

Look-up processor 116*s* receives an index $I_1$ and, based thereon, identifies an orthogonalized vector from processor 116*e,* $V_{wc1}{}^{o}$. The fixed codebook 116*d,* weighting processor 116*b,* and orthogonalization processor 116*e* are the same as their counterparts presented in FIG. 9.

Look-up processor 116*u* is identical to processor 116*s* except that it receives an index $I_2$ and, based thereon, identifies an orthogonalized vector from processor 116*g,* $V_{wc2}{}^{o}$. The fixed codebook 116*h,* weighting processor 116*b,* and orthogonalization processor 116*g* are the same as their counterparts presented in FIG. 9.

2. The Prototype Interpolation Processor

The prototype interpolation processor 140 operates to interpolate the shape of aligned prototypes to reconstruct an estimate of the residual signal, $\hat{r}$, sample by sample.

As stated above, the description of prototype waveforms may be either in the time or frequency domains. Thus, interpolation of prototype waveforms may also occur in either domain. When interpolating in the time domain, the duration of time-domain features of the prototype waveform are not changed with changing pitch-period, while in the frequency domain the duration of such features is proportional to the pitch period.

In this embodiment, processor 140 receives as input the phase shift $\xi$ determined by the alignment processor 116*p* of the prototype dequantizer 116; values for the pitch-period valid at $FB_n$ and $FB_{n+1}$, $p_n$ and $p_{n+1}$, from pitch-period store 170 and pitch-period dequantizer 118, respectively; Fourier series coefficients for an aligned prototype valid at $FB_n$, $\hat{S}_n=\{\hat{A}_n(j), \hat{B}_n(j)\}$ and the aligned prototype valid at $FB_{n+1}$, $\hat{S}_{n+1}=\{\hat{A}_{n+1}(j), \hat{B}_{n+1}(j)\}$. Processor 140 maintains a phase, $\phi$, which takes on values between 0 and $2\pi$ over each pitch-cycle of the reconstructed residual signal; interpolated values of the aligned coefficients $\hat{A}$ and $\hat{B}$; and interpolated values of the pitch-period, p. Illustratively, prototype interpolation processor 140 operates in accordance with the procedure presented in FIG. 15.

Processor 140 determines a frame of an estimated residual, $\hat{r}$, between frame boundaries, e.g., $FB_n$ and $FB_{n+1}$, by linear interpolation of the prototype waveforms $\hat{S}_n$ and $\hat{S}_{n+1}$. The duration of the interpolation interval—a frame such as $F_n$—is $T_F$. The beginning of the interpolation interval, i.e., t=0, coincides with the last sample point of the previous frame located at boundary $FB_n$. The end of the interpolation interval, $t=T_F$, coincides with boundary $FB_{n+1}$.

Processor 140 begins operation by determining initial values for parameters of the interpolation process (see 141). As shown in FIG. 11 these include values for the sample index t, pitch-period, p(t), phase, $\phi(t)$, and Fourier series coefficients, $\hat{A}(j,t)$ and $\hat{B}(j,t)$.

The initial value of the sample time, t, is set equal to zero to reflect the position of the frame boundary, $FB_n$, at the beginning of the interpolation interval.

Figure 16:
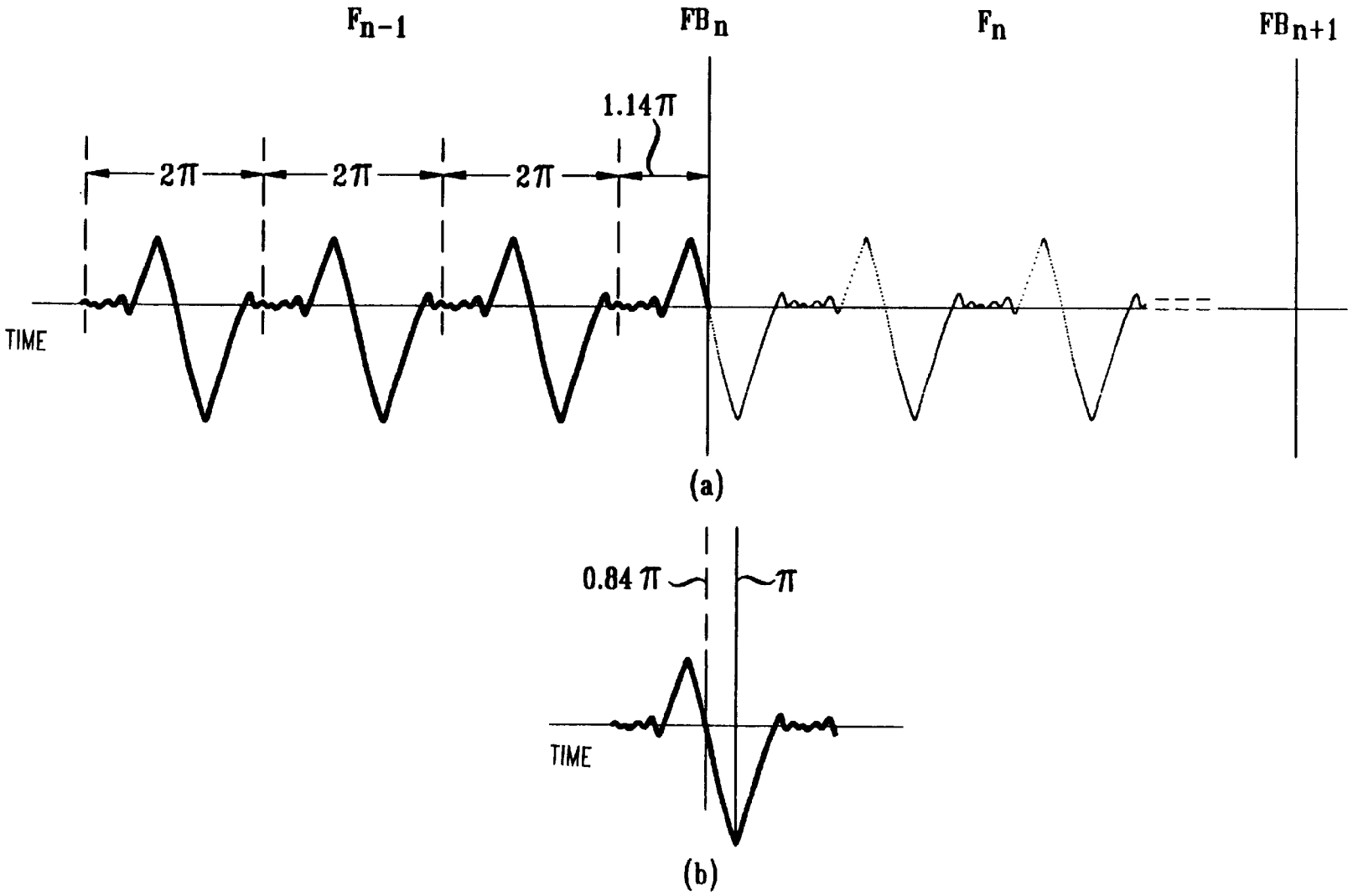
FIG. 16(*a*) presents a frame of a reconstructed residual signal.

The initial value of phase relates the prototype at $FB_n$ to the last pitch-cycle of the reconstructed residual in the previous frame, $F_{n-1}$. As shown in FIG. 16(*a*), the previous frame, $F_{n-1}$,comprises several complete pitch-cycles of the estimated residual. Each of these complete pitch-cycles is signified as having phase duration $2\pi$. Frame $F_{n-1}$ further comprises a partial pitch-cycle immediately preceding the frame boundary, $FB_n$. This partial pitch-cycle is the result of a previous interpolation process (for frame $F_{n-1}$) terminating at boundary $FB_n$. This termination halted residual computation at a phase of $1.14\pi$ (out of $2\pi$) in the last pitch-cycle of the frame. This value, $1.14\pi$, comprises a final phase, $\phi_l$, of the last pitch-cycle of the estimated residual. Thus, the previous interpolation process halted computation of the estimated residual after computing a residual sample valid at frame boundary $FB_n$. At that time, the phase of the estimated residual was $1.14\pi$ into a pitch-cycle.

In order to provide continued smooth interpolation of the estimated residual in frame $F_n$, the initial phase at boundary $FB_n$ must take into account the alignment performed by processor 116*p*. This initial phase, $\phi(0)$, of the interpolation process for frame $F_n$ is determined as follows:

$$\phi(0)=\phi_l-\xi. \tag{22}$$

Figure 10:
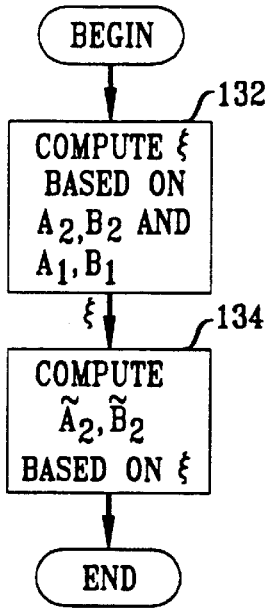
FIG. 10 presents a procedure for operation of an alignment processor presented in FIG. 9.

The result of the phase shift $\xi$ may be seen with reference to FIG. 16(*b*). FIG. 16(*b*) presents the prototype valid at $FB_n$ aligned to the single-pulse reference prototype of stores 116*o* and 93*o* by the phase shift $\xi$. By virtue of this alignment, the major positive peak of this prototype is located at the center of a pitch-cycle, designated as $\pi$. In the example of FIGS. 10 and 16(*a*), $\xi=+0.3\pi$ and $\phi_l=1.14\pi$. Thus, according to (22), the initial phase of the interpolated residual based upon the aligned prototype valid at $FB_n$ is $0.84\pi$. It can be seen from FIG. 16(*b*) that a phase $0.84\pi$ in the aligned prototype corresponds accurately to end of the last prototype in frame $F_{n-1}$ (at phase $1.14\pi$). Thus, with the phase modification of (22), a smooth interpolation of prototypes across frame boundaries is provided. The alignment was used to ensure that the pitch pulse of $S_{n+1}$ is near or at the center of the prototype, after alignment by 93*a,* facilitating its quantization.

Figure 15:
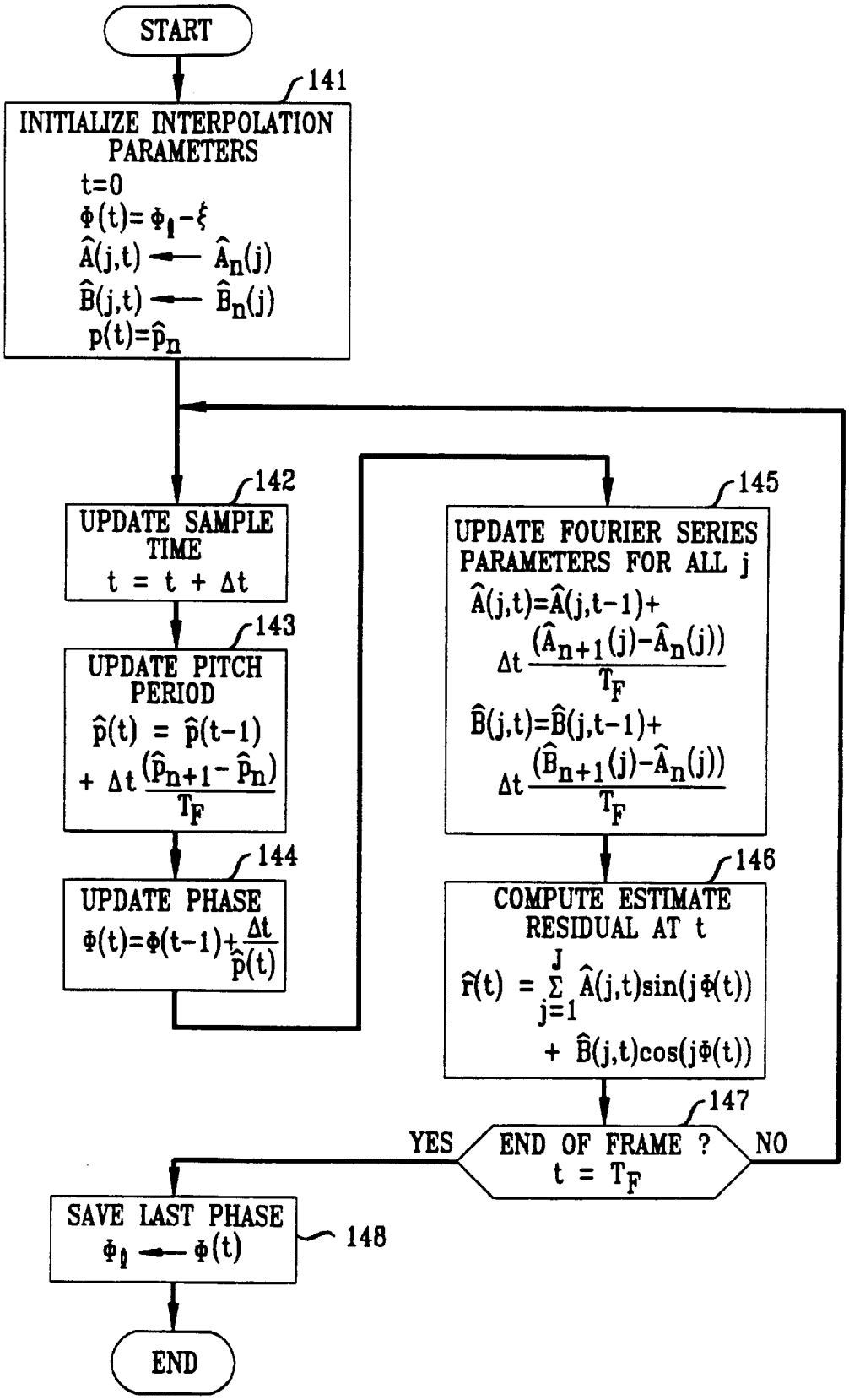
FIG. 15 presents a procedure for operation of a prototype interpolation processor presented in FIG. 12.

Regarding the other parameters shown in FIG. 15, the Fourier series coefficients, $\hat{A}(j,t)$ and $\hat{B}(j,t)$, are initialized to the values of the coefficients of the aligned prototype valid at $FB_n$, $\hat{A}_n$ and $\hat{B}_n$, respectively. The pitch-period, p(t), is initialized to the value of the communicated pitch-period valid at $FB_n$, $p_n$.

With the initial parameters of the interpolation process determined, a recursive process may be performed to determine values of the estimated residual for frame $F_n$. As shown in FIG. 11, this recursive process begins with an update to the sample time (see 142). In this example, the sample time is incremented by $\Delta t$, which corresponds to one sampling period.

Next, pitch period, p(t), is updated by linear interpolation (see 143):

$$p(t) = p(t-1) + \Delta t \frac{p_{n+1} - p_n}{T_F} . \tag{23}$$

Values for $p_{n+1}$ and $p_n$ are provided by the pitch-period dequantizer 118 and pitch-period store 170, respectively.

After updating the pitch-period, the phase is updated (see 144):

$$\phi(t) = \phi(t-1) + \frac{\Delta t}{p(t)} . \tag{24}$$

After an update of the phase, the Fourier series coefficients are updated by linear interpolation (see 145):

$$\hat{A}(j,t) = \hat{A}(j,t-1) + \Delta t \frac{\hat{A}_{n+1}(j) - \hat{A}_n(j)}{T_F} ; \tag{25}$$

$$\hat{B}(j,t) = \hat{B}(j,t-1) + \Delta t \frac{\hat{B}_{n+1}(j) - \hat{B}_n(j)}{T_F} . \tag{26}$$

Interpolation in (23), (25), and (26) has been performed linearly in time. Alternatively, these interpolations may be performed linearly in phase.

A value for the estimated residual sample at time t, $\hat{r}(t)$, is computed according to the general form presented in (3), above (see 146):

$$\hat{r}(t) = \sum_{j=1}^{J} \hat{A}(j,t)\sin(j\phi(t)) + \hat{B}(j,t)\cos(j\phi(t)), \tag{27}$$

where t is the sample index, j is the Fourier series harmonic index, $\hat{A}(j,t)$ and $\hat{B}(j,t)$ are the Fourier series coefficients for the jth harmonic at sample t, and $\phi(t)$ is the instantaneous phase of the Fourier series at sample t.

If the value of the residual sample just computed is valid at the next frame boundary, e.g., $FB_{n+1}$, the phase value at that sample, $\phi(t)$, should be saved for use as a final phase, $\phi_l$, in the phase initialization of the next frame, $F_{n+1}$, and the process may end (see 147 and 148). Determination of a frame boundary may be made by comparing the present sample index, t, to the total number of samples in a frame, $T_F$.

If the sample index is not coincident with the next frame boundary, the iterative process continues with a further update to the sample count, etc., as shown in FIG. 11. Each iteration of this process produces, among other things, a sample value of $\hat{r}(t)$. Each sample value of $\hat{r}(t)$ is saved in a buffer of length 160 samples (i.e., a buffer storing a frame of residual samples). As a result of the operation of the prototype interpolation processor 140, this frame of estimated residual samples, $\hat{r}_F$, is provided as output to IIR filter 190.

3. The LP Coefficient Interpolation Processor

The LP coefficient Interpolation processor 160 determines LP coefficients valid at the center of sub-frames based on LP coefficients received from the LP coefficient dequantizer 114 and coefficient store 150. The sub-frame coefficients are provided as output to filter 190, which uses them to filter individual sub-frames of a reconstructed residual frame, $\hat{r}_F$.

The determination of LP coefficients valid at the center of sub-frames is accomplished by interpolation between the received coefficients, $\hat{a}_n$ and $\hat{a}_{n+1}$, provided by the coefficient store 150 and the LP coefficient dequantizer 114, respectively, in the manner discussed above with respect to the linear prediction analyzer 10. Processor 160 interpolates to sample values at $\frac{1}{8}$ $T_F$, $\frac{3}{8}$ $T_F$, $\frac{5}{8}$ $T_F$, and $\frac{7}{8}$ $T_F$ in the manner well known in the art.

4. The IIR Filter

The IIR filter 190 receives and buffers a frame of reconstructed residual signal, $\hat{r}_F$, from the buffer 180, and filters it to produce a frame of reconstructed speech, $\hat{x}_F$. The IIR filter 180 is a conventional inverse linear prediction filter having a transfer function which is the inverse of (1). The filter 190 processes a frame of the estimated residual one sub-frame at a time, using LP coefficients valid at the center of the subframe in question provided by processor 160, as described above. The resulting filtered subframes are buffered and output as a frame of reconstructed original speech, $\hat{x}_F$. Frames of reconstructed residual signals are concatenated in time by buffer 200 to provide a complete estimate of the original digital speech signal, $\hat{x}$.

This digital speech signal, $\hat{x}$, may be provided for further processing in the digital domain or may be converted to an analog signal for transduction to an acoustic signal. Conversion to an analog signal may be performed by conventional digital-to-analog conversion. Transduction to an acoustic signal from an analog signal may be accomplished by an ordinary loudspeaker.

D. Use of Prototype Waveform Speech Coding with Conventional Coding of Unvoiced Speech Advantageously, the waveform interpolation procedure may be used for the generation of voiced speech signals only. During unvoiced, the speech signal can be coded with other, known methods, such as CELP which can be tailored for the encoding of unvoiced speech sounds. The decision of which of these two modes is to be used can be made using existing techniques, including those described in: S. Wang, *Low Bit-Rate Vector Excitation Coding of Phonetically Classified Speech,* Ph.D. thesis, University of California, Santa Barbara, 1991.

At the onset of a voiced section of speech, the past estimated prototype waveform, denoted in section C2 as $\hat{S}_n$, is not present. In this case, this prototype can 1) be estimated according to the principles described in section B from the reconstructed signal occurring prior to the frame boundary $FB_n$ or 2) be set to a single pulse waveform, with its amplitude determined from transmitted information, or 3) be a replica of the prototype $\hat{S}_{n+1}$, 4) be a replica of the prototype $\hat{s}_{n+1}$, but with modified energy. In cases 3) and 4), the previous quantized prototype (PQP) used for the quantization of $S_{n+1}$, is advantageously set to be a single, centered pulse, as stored in 93*o* and 116*o*. Note that in case 1) the appropriate starting phase $\phi(0)$ can be determined at the decoder. However, in general, the onset of voiced sections is abrupt, and the starting phase at the beginning of such a voiced section is not critical. However, it may be useful to transmit information describing the location of the first pitch pulse in such cases (the signal prior to the onset is then filled in by a noise signal with power and spectral characteristics of the previous frame). In addition, one may transmit a single bit of information concerning the type of transition, and choose either case 1), or one of 2), 3), and 4) for "smooth", and "abrupt" transitions, respectively.

Discontinuities in the speech waveform can be entirely avoided at the voiced-unvoiced transition. Since the last prototype waveform was extracted from the original speech signal, the final phase $\phi_l$ of the last frame corresponds to a particular time in the original residual signal. The value $\phi_l$ can be computed at the encoder. Upon identifying this point, the buffer of original speech signal is displaced, such that this point in the original speech corresponds to the frame boundary $FB_{n+1}$. Thus, the CELP algorithm starts exactly where the waveform coder has ended, and continuity of the reconstructed signal is insured. The resulting time mismatch between original and reconstructed signal can be minimized by adjusting the buffer during occasions of silence, or by inserting or eliminating exactly complete pitch cycles during the entering of voiced speech segments into buffer 11.

I claim:

1. A method of synthesizing a speech signal based on signals communicated via a communications channel, the method comprising the steps of:

receiving at least two communicated signals, including (i) a first communicated signal comprising a first pitch-period and a first set of frequency domain parameters, the first set of frequency domain parameters representing a first residual signal representative of a first speech signal segment of a length equal to said first pitch-period, and (ii) a second communicated signal comprising a second pitch-period and a second set of frequency domain parameters, the second set of frequency domain parameters representing a second residual signal representative of a second speech signal segment of a length equal to said second pitch-period;

interpolating between the first pitch-period and the second pitch-period to generate an interpolated pitch-period;

interpolating between the first set of frequency domain parameters and the second set of frequency domain parameters to generate a set of interpolated frequency domain parameters;

generating a reconstructed residual signal based on said set of interpolated frequency domain parameters and on said interpolated pitch-period, the reconstructed residual signal representing an interpolated speech signal segment of a length equal to said interpolated pitch-period; and synthesizing the speech signal based on the reconstructed residual signal.

2. The method of claim 1 wherein the parameters comprise Fourier series coefficients.

3. The method of claim 1 wherein the first residual signal comprises the first speech signal segment filtered with a linear predictive filter and the second residual signal comprises the second speech signal segment filtered with said linear predictive filter.

4. The method of claim 3 wherein the first communicated signal comprises a first set of linear predictive filter coefficients and the second communicated signal comprises a second set of linear predictive filter coefficients.

5. The method of claim 4 further comprising the step of interpolating between said first set of linear predictive filter coefficients and said second set of linear predictive filter coefficients to generate an interpolated set of linear predictive filter coefficients, and wherein said step of synthesizing the speech signal is further based on said interpolated set of linear predictive filter coefficients.

6. A speech decoder for synthesizing a speech signal based on signals communicated via a communications channel, the decoder comprising:

means for receiving at least two communicated signals, including (i) a first communicated signal comprising a first pitch-period and a first set of frequency domain parameters, the first set of frequency domain parameters representing a first residual signal representative of a first speech signal segment of a length equal to said first pitch-period, and (ii) a second communicated signal comprising a second pitch-period and a second set of frequency domain parameters, the second set of frequency domain parameters representing a second residual signal representative of a second speech signal segment of a length equal to said second pitch-period;

means for interpolating between the first pitch-period and the second pitch-period to generate an interpolated pitch-period;

means for interpolating between the first set of frequency domain parameters and the second set of frequency domain parameters to generate a set of interpolated frequency domain parameters;

means for generating a reconstructed residual signal based on said set of interpolated frequency domain parameters and on said interpolated pitch-period, the reconstructed residual signal representing an interpolated speech signal segment of a length equal to said interpolated pitch-period; and means for synthesizing the speech signal based on the reconstructed residual signal.

7. The decoder of claim 6 wherein the parameters comprise Fourier series coefficients.

8. The speech decoder of claim 6 wherein the first residual signal comprises the first speech signal segment filtered with a linear predictive filter and the second residual signal comprises the second speech signal segment filtered with said linear predictive filter.

9. The speech decoder of claim 8 wherein the first communicated signal comprises a first set of linear predictive filter coefficients and the second communicated signal comprises a second set of linear predictive filter coefficients.

10. The speech decoder of claim 9 further comprising means for interpolating between said first set of linear predictive filter coefficients and said second set of linear predictive filter coefficients to generate an interpolated set of linear predictive filter coefficients, and wherein said means for synthesizing the speech signal is further based on said interpolated set of linear predictive filter coefficients.

* * * * *